US011732430B2

(12) United States Patent
Favorito et al.

(10) Patent No.: US 11,732,430 B2
(45) Date of Patent: Aug. 22, 2023

(54) SNOW PLOW-BLOWER

(71) Applicants: Paul Favorito, Morgansville, NJ (US); Franceso Marino, Staten Island, NY (US)

(72) Inventors: Paul Favorito, Morgansville, NJ (US); Franceso Marino, Staten Island, NY (US)

( * ) Notice: Subject to any disclaimer, the term of this patent is extended or adjusted under 35 U.S.C. 154(b) by 241 days.

(21) Appl. No.: 16/798,373

(22) Filed: Feb. 23, 2020

(65) Prior Publication Data

US 2021/0262183 A1 Aug. 26, 2021

(51) Int. Cl.

| | |
|---|---|
| ***E01H 5/07*** | (2006.01) |
| ***E01H 5/06*** | (2006.01) |
| ***E01H 5/10*** | (2006.01) |
| ***E01H 5/09*** | (2006.01) |

(52) U.S. Cl.

CPC ..... *E01H 5/076* (2013.01); *E01H 5/061* (2013.01); *E01H 5/065* (2013.01); *E01H 5/066* (2013.01); *E01H 5/096* (2013.01); *E01H 5/098* (2013.01); *E01H 5/10* (2013.01)

(58) Field of Classification Search

CPC ..... E01H 5/061; E01H 5/065; E01H 5/066; E01H 5/079; E01H 5/096; E01H 5/098; E01H 5/10; E01H 5/04; E01H 5/06; E01H 5/09

See application file for complete search history.

(56) References Cited

U.S. PATENT DOCUMENTS

| | | | | |
|---|---|---|---|---|
| 3,309,798 | A | 3/1967 | Devlin et al. | |
| 4,356,645 | A | 11/1982 | Hine et al. | |
| 4,479,312 | A | 10/1984 | Turgeon | |
| 5,899,007 | A | 5/1999 | Niemela et al. | |
| 7,681,337 | B2 | 3/2010 | Watson | |
| 9,359,734 | B2 * | 6/2016 | Favorito | E01H 5/09 |
| 9,708,782 | B2 * | 7/2017 | Houle | E01H 5/045 |
| 2004/0216333 | A1 | 11/2004 | Quenzi et al. | |
| 2009/0217554 | A1 | 9/2009 | Tucker | |
| 2010/0205834 | A1 | 8/2010 | McKeown et al. | |
| 2011/0067273 | A1 | 3/2011 | Koch et al. | |
| 2011/0239491 | A1 | 10/2011 | Chen | |
| 2012/0279093 | A1 * | 11/2012 | Niemela | E01H 5/098 37/242 |
| 2013/0298429 | A1 | 11/2013 | Niemela et al. | |
| 2015/0068074 | A1 * | 3/2015 | Mast | E01H 5/045 37/197 |

* cited by examiner

*Primary Examiner* — Jamie L McGowan

(74) *Attorney, Agent, or Firm* — Ernest D. Buff & Associates, LLC; Ernest D. Buff

(57) ABSTRACT

A snow plow-blower operates as a snow plow, snow blower/thrower or as a snow plow-blower combination. The snow plow-blower includes a plow head blade and at least one blower door. The cavity contains a snow moving means, single, dual, or multi staged, for moving snow, ice and other materials out through at least one discharge chute and/or at least one opening. The blower door is adapted to move to a partially open configuration to expose the cavity, and from the partially open configuration to a partially closed configuration to thereby decrease snow, ice and other material ingress into the snow blower unit. Preferably, at least one retractable and extendable wing is located on the plow head blade to advantageously provide varying closed and open extended position configurations or positions for the removal of snow, ice or other material and debris.

43 Claims, 18 Drawing Sheets

SNOW PLOW-BLOWER

BACKGROUND OF THE INVENTION

1. Field of the Invention

The present invention relates to snow moving machines; and, more particularly, to a snow plow-blower apparatus adapted to be used in operation with a vehicle/moveable machine to plow and/or remove snow.

2. Description of the Prior Art

Snow removal is a tedious and costly operation for residents, municipalities and commercial enterprises and involves attachments that are generally mounted on vehicles for use when removing snow and ice from outdoor surfaces such as roads and parking lots. Snow plows typically use a blade to push snow to the side or straight ahead, clearing the snow from a surface resulting in snowbanks and piles build-up along the side of the roadway or the like, causing dangerous conditions and visibility issues at intersections and driveways. As additional snow accumulates resultant snow banks or piles from plowing become increasingly difficult to manage.

Another alternative to snow removal involves the use of snow blowers, which remove and/or throw snow from one location to another. Snow blowers or snow throwers generally involve machines for removing snow from an area where it is not wanted, such as a driveway, sidewalk, roadway, railroad track, rink, runway, or parking lot. While snow throwers are generally like snow blowers, snow throwers involve machines that use a single stage to remove or "throw" snow while snow blowers use two stages to remove or "blow" snow. Such snow throwing and snow blowing devices typically use either electric power, or a gasoline or diesel engine to energize the throwing or blowing of snow to another location or into a truck to be hauled away. This throwing or blowing operation is in contrast with the action of snowplows, which merely push snow to the front or side.

In operation, snow blowers are broadly divided into two classes, single stage and two stages. Single-stage snow throwers implement a single snow moving part, such as a high speed impeller or auger, to both move the snow into the machine and force it out of a discharge chute. Two or more curved paddles can optionally be utilized to move snow towards the centerline of the machine where the discharge chute is located. These single-stage snow throwers usually are light-duty machines. In a two-stage machine, two mechanisms move the snow; an auger feeds the snow to a high-speed impeller, which blows the snow out of the machine. These two-stage snow blowers generally range from small machines having a few horsepower to commercial grade large machines powered by diesel engines of over 1000 horsepower (746 kW). Generally, the large machines are used for clearing roadways and airport runways, often by throwing the snow into trucks, which haul it away.

A variety of devices have been suggested for forming snow plow-blower units. For example:

U.S. Pat. No. 1,552,714 to Linzy discloses a rotary snowplow. A chassis frame carries an engine, transmission, driving shaft and reverse control. At the front of the chassis is provided a housing carrying a peripherally mounted member.

U.S. Pat. No. 2,777,218 and counterpart Foreign Patent Publication No. CA646078 to Kiecker et al. disclose a combination snow plow and blower normally drawn by an implement such as a tractor.

U.S. Pat. No. 3,309,798 to Devlin et al. discloses a snow melter.

U.S. Pat. No. 3,911,601 to Maheu discloses a snow blower vehicle comprising a snow plow assembly mounted on the front of a vehicle chassis. The snow plow assembly has an open fronted scoop and a scraper blade resiliently mounted on the lower edge of the scoop.

U.S. Pat. No. 4,023,287 to De Brito discloses a plow attachment for a snow blower that may be pivoted between work and storage positions, about a horizontal axis located rearwardly of the snow blower blade and may be angularly adjusted about a vertical axis. The plow attachment includes a frame and a blade which may be readily connected to and removed from the frame.

U.S. Pat. No. 4,249,322 to Mclaughlin et al. discloses a vehicle-mounted snowplow having a scoop with a large intake opening for receiving snow and air. The scoop tapers to a narrow throat connected to an outlet means. Airspeed through the scoop is increased as the scoop narrows so that the air carries the scooped snow through the outlet means and discharges it from the outlet means at a high velocity.

U.S. Pat. No. 4,356,645 to Hine et al. discloses a variable wing plow blade and mounting structure for attaching the plow blade to a tractor, snow grooming vehicle, and the like feature distribution of the load on the blade over a relatively wide area of the supporting structural members thereby to permit reduction in their size, weight and number and in their manufacturing and assembling costs while maintaining the essential structural strength.

U.S. Pat. No. 5,127,174 to Takeshita discloses an improved snow thrower and specifically an improved blower that improves efficiency and reduces the likelihood of snow accumulation.

U.S. Pat. No. 5,513,453 to Norton discloses a combined snow plowing and snow throwing vehicle that includes an elongate plow blade at its forward end. The plow blade can be shifted to direct snow to either the right or the left, and includes separate snow throwing fans mounted, respectively, at the right and left ends of the plow blade.

U.S. Pat. No. 4,479,312 to Turgeon discloses a foldable snow compactor that has a center pan with a pair of operatively positioned wings extending from the ends thereof. The wings are mounted for pivotal movement about axes fixed in relation to the center pan.

U.S. Pat. No. 5,899,007 to Niemela et al. discloses a plow assembly for vehicles such as pickup trucks and tractors for moving snow or other materials has at least one extendable, forwardly pivotable plow wing which is extendable on one end of a main plow by sliding movement along the front of the plow between a retracted and an extended position in which the plow wing is generally aligned with the plow front surface.

U.S. Pat. No. 5,915,835 to Fair discloses a snowblower including a housing. Attached to the snowblower is a drive mechanism that actuates a snow gate for movement about a vertical axis, inwardly towards and outwardly away from the snowblower housing.

U.S. Pat. No. 6,154,985 to Champagne et al. discloses a device for use with a snow blower being of the type having an auger. The device allows the snow blower to operate while moving backward.

U.S. Pat. No. 6,367,176 to Zaugg et al. discloses a rotary snow blower plow with a plow worm which delivers the snow and a fan blower which throws the delivered snow. The fan blower is located on a line with the plow worm. The fan blower and the plow worm can be mounted on a common shaft so that they rotate with the same angular speed.

U.S. Pat. No. 6,513,267 to Yoshida et al. discloses a snow removing machine equipped with a snow removing plate. The snow removing plate is mounted to a front portion of a vehicle body which forms part of the snow removing machine. An operating handle having grip portions is mounted to a rear portion of the vehicle body and obliquely extends upward.

U.S. Pat. No. 7,174,660 to Sakai et al. discloses a snow removing machine having an auger for plowing and collecting snow, a rotatable blower for throwing snow collected by the auger, and a shooter for guiding the snow thrown by the blower so that the snow reaches a selected point. The blower has a central shaft part and blades extending radially outwardly from the shaft part.

U.S. Pat. No. 7,681,337 to Watson discloses a plow assembly comprises a blade, structure attached to the blade and adapted to be attached to a vehicle for mounting the blade to and supporting the blade from the vehicle, and a wing attached to an end of the blade. The wing has a first portion mounted to the blade for translational movement relative thereto, and a second portion mounted to the first portion for rotational movement relative thereto.

U.S. Pat. No. 8,191,289 to Raftery discloses a skid for use on a snow blower. The snow blower includes an auger housing through which snow removed from an area is channeled. The skid includes a body that is secured to a vertical side wall of the auger housing.

U.S. Pat. No. 9,359,734 to Favorito et al. discloses a snow plow-blower operates as a snow plow, snow blower, or as a snow plow-blower combination. The device includes a plow head blade optionally having retractable/pivotal scoop wings and a cavity with an aperture with blower doors and a blower unit. The snow blower unit includes an auger and impeller to move snow into the unit and force it out of a discharge chute. Blower doors are provided over the snow blower unit cavity to prevent snow from entering the cavity when the blower is off. Optionally, the blower doors move along a track and rest flush against the plow head to open and close off access to the cavity.

U.S. Patent Application Publication No. 20100205834 to Mckeown et al. discloses an apparatus and a method of clearing an accumulation of matter from a surface is provided. The apparatus includes a collecting section, a casting section, and a shifting section. The shifting section is at least one of a diverting section, a sweeping section, and an air blowing section.

U.S. Patent Application Publication No. 20040216333 to Quenzi et al. discloses a plow assembly includes a pair of plow wings which are pivotally mounted at opposite ends of a center plow. Each of the plow wings may pivot between a forwardly angled position and an aligned position. The plow assembly may pivot a trailing plow wing in response to the center plow being urged or angled toward that side of the vehicle.

U.S. Patent Application Publication No. 20090307941 to Gamble discloses a plow, including a center blade and a wing blades coupled to each end of the center blade. Each wing blade is pivotally connected to the center blade about an axis.

U.S. Patent Application Publication No. 20090217554 to Tucker discloses an upright induction chamber is positioned within a melting tank of a snow melting apparatus. The melting tank is filled with melting water. Shredded snow from a hopper assembly is introduced into the upper end of the induction chamber along with heated melting water, to be mixed by an impeller fan pump that is operated to force the melting water at sufficient speed through the induction chamber to overcome the buoyancy of the snow, thereby facilitating uniform distribution of the snow across the induction chamber and good mixing of the snow with the melting water.

U.S. Patent Application Publication No. 20110113657 to Mills discloses a snow deflector apparatus that easily attaches to a snowplow. The deflector apparatus includes a kit, and the snowplow system includes two snow deflectors and a control system.

U.S. Patent Application Publication No. 20110239491 to Chen discloses a remnant snow removing apparatus for a snow thrower includes a scraper bucket and at least one extension panel located on the scraper bucket.

U.S. Patent Application Publication No. 20110067273 to Koch et al. discloses a snow plow including a quick connect/disconnect hitch. The snow plow includes a hitch frame nose assembly configured to couple to a vehicle. The hitch frame nose assembly includes a chassis coupler secured at each end of a hitch frame tube with each chassis coupler including a traverse pin. A plow frame is included with the plow frame having a front portion and a rear portion. A plow blade is coupled to the front portion of the plow frame.

U.S. Patent Application Publication No. 20120079749 to Dimario discloses a device and method of use of a plow back blade for snow removal. The plow back blade is attached to a snowplow or snow blower to assist with removing snow from areas that are otherwise difficult to access with conventional snow removal equipment. The plow back blade is rotatably attached to a snowplow blade at a pivot point.

U.S. Patent Application Publication No. 20120279093 to Niemela et al. discloses a combination snow blower and plow apparatus that provides at least two operating configurations including (i) a standard-width snow blowing configuration, and (ii) an expanded-width plowing and blowing configuration.

U.S. Patent Application Publication No. 20130298429 to Niemela et al. discloses a combination snow blower and plow apparatus provides at least two operating configurations including a standard-width snow blowing configuration, and a snow plowing configuration, movable between a lowered deployed position for engaging snow, and a raised undeployed position for disengaging the plow assembly from the snow.

Foreign Patent Publication No. JP2003041544 to Morimoto et al. discloses a blower for a snow plow. The blower reduces noise during work and surely discharges collected snow to a snow discharge chute. The snow discharge is affected by radially standing a plurality of blades, etc., in a blower baseboard and bending a tip part of each blade in the turning direction.

Foreign Patent Publication No. CA2133495 to Pedersen discloses a scraping implement that can be quickly coupled and uncoupled to a conventional self-propelled snow blower for the removal of snow from a driveway or sidewalk.

Non-Patent Literature entitled "Unimog Snow Plow" found at http://www.youtube.com/watch?v=oig5NGc8Qb4 (hereinafter, "the Unimog publication") discloses a Unimog 1200 and RASCO Karnik 3.0 snow plow.

Non-Patent Literature entitled "Crafts Manual-Stage Snow Blower Tractor Attachment" found at http://www.searsoutlet.com/d/product_details.jsp?pid=41354&mode=buyUsedOnly&sid=IDx20110411x000008&ci_sku=8797230&ci_gpa=pla&ci_kw={keyword} (hereinafter, "the 'Crafts publication") discloses a dual-stage snow blower tractor attachment. The dual-stage snow blower tractor attachment is connected to a lawn tractor type device.

Notwithstanding the efforts of prior art workers there remains a need in the art for a snow plow-blower apparatus adapted to be used in operation with a vehicle to plow and remove snow, wherein the blower and/plow function can operate unilaterally or in conjunction with one another and wherein a single and/or dual snow blower is utilized. Further, there exists a need in the art for a snow plow-blower apparatus wherein doors are provided for closing the snow-blower orifice when not needed and wings are retractable and pivotal on the snow plow blade. Additionally, there exists a need in the art for a snow plow-blower apparatus having the ability to direct snow as needed to prevent clogging and/or jamming of the apparatus, and wherein wheels are provided for improved maneuverability.

SUMMARY OF THE INVENTION

The present invention provides an improved snow plow-blower apparatus that is especially well suited for use in operation with a land vehicle/movable unit to remove snow, providing a single and/or dual blower configuration. Generally stated, the snow plow-blower comprises a plow head blade; at least one blower door; a snow blower unit having snow moving means for moving snow, ice and other materials out through at least one discharge chute and/or at least one opening; said at least one blower door being operative to move to a first position to expose said snow moving means, and from said first position to a second position wherein said snow moving means is unexposed to said snow, ice and other materials.

More specifically, the subject snow plow-blower is constructed having a moldboard forming a plow head blade, an opening or cavity housing a snow plow blower or thrower containing snow moving means such as at least one impeller or rotary fan, one or more blower door, and optionally one or more wing. The blower and/plow function can be realized unilaterally or in conjunction with one another. The plow head blade itself may be the one or more blower door, wherein the plow head blade is moveable from a first position to a second position to expose the opening or aperture ingress into the cavity contained by the snow blower unit. Alternatively, the cavity housing the blower can be covered by the one or more blower doors that are integrated within the plow head blade and move therewithin to open and close, at varying degrees, to allow snow ingress during snow plow blowing or prevent snow ingress when, for example, the blower is not being utilized or when snow moving efficiencies are increased by plowing without blowing the snow. The blower door preferably has varying degrees of open and closing configurations, so that the door or doors may be partially opened or partially closed. The one or more blower doors cover and close the cavity, and are capable of retracting, moving and/or pivoting operations to convert the apparatus from a snow plow to a snow plow blower. The one or more blower doors are operable to enhance snow plowing, allow conversion to a snow blower/thrower, and/or mitigate or prevent clogging.

Optionally, one or more wing is provided, preferably at least two wings are provided, that retract, move or pivot along the plow head blade, to enhance snow plowing, keep snow contained in a location to prevent unwanted snow distribution and/or snow pile placement. Preferably, the one or more wing is arched or curved. Further, the at least one wing is used in order to manage removal operations, depending on storm conditions, and/or the type of material to be removed.

Single user maneuverability is enhanced when dismounted from a transport vehicle/moveable machine using specially engineered shoes or wheels fixedly or removably mounted on ski-like skids and/or the plow snow plow blower (apparatus). The wheel or shoe may optionally be powered to vertically displace the snow plow-blower. In a first embodiment, a snow plow-blower is provided constructed having a plow head blade, an aperture ingress into a cavity with one or more blower doors. It is noted that in one embodiment, the plow head blade does not have the aperture integrated therein, and the plow head blade itself is the blower door, capable of moving upward and downward along the vertical plane to open and expose the aperture and visa vie the cavity (i.e. the aperture is essentially the opening to the cavity) and allow snow blowing operation. As the plow head blade moves downward it closes over the aperture and visa via cavity to close access to the blower unit. Alternatively, the plow head blade has the aperture opening of the cavity integrated therein. In this embodiment, the plow head blade has the aperture integrated in the plow head blade and blower doors are moveable on the plow head blade to expose the aperture and provide access to the cavity and visa via the snow plow blower unit housed therein.

The snow blower unit is in communication with a power source adapted to move snow, ice and other materials out through at least one discharge chute and/or at least one opening. The one or more blower doors are adapted to move into closed and open configurations, wherein the one or more blower doors moves from an open to a completely closed configuration to thereby completely close the aperture of the cavity, preventing all snow, ice and other material ingress into the snow blower unit when the snow blower unit is not being utilized. At least one wing and preferably at least two wings are located on the opposing side walls of the plow head blade. The at least one wing is retractable and extendable in relation to the plow head blade to yield a closed position and open extended position.

The snow blower unit may be a dual stage snow blower unit comprising at least one auger and impeller in communication with a power source adapted to move snow, ice and other materials into the unit and force it out of at least one discharge chute and/or at least one opening. Alternatively, the snow blower unit is a single stage snow blower unit comprising at least one auger in communication with a power source adapted to move snow, ice and other materials through at least one discharge chute and/or at least one opening. In another embodiment, the snow blower unit comprises at least one impeller or fan in communication with a power source adapted to move snow, ice and other materials through at least one discharge chute and/or at least one opening. In yet another embodiment, the snow blower unit comprises at least one rotary fan thrower or blower in communication with a power source adapted to move snow, ice and other materials through at least one discharge chute and/or at least one opening. The snow blower unit may comprise at least one ribbon cutter or barrel-shaped, and/or conic-sectional-shaped (aka cone shape/double cone shape) cutter in communication with a power source adapted to move snow, ice and other materials and force it out of at least one discharge chute and/or at least one opening. Alternatively, the snow blower unit comprises at least one cutter or type of device in order to proficiently process snow, ice and debris in communication with a power source adapted to move snow, ice and other materials and force it out of at least one discharge chute and/or at least one opening.

The plow head blade of the snow plow-blower may further include a moldboard, curved plate or outer covering which, together with a hinge located near the center of the moldboard, enables the plow head blade to transform to different shaped moldboard configurations. The moldboard configurations preferably include a straight blade, an angled blade, a scooped blade, a windrow blade, a wedge blade, a v-shaped blade and/or combination thereof.

The blower door may be a single blower door adapted to move upward and downward over the cavity to open and close the cavity. Alternatively, the blower door comprises at least one blower door, preferably at least two blower doors, adapted to move upward and downward over the cavity to open and close the cavity. The blower doors may move laterally or horizontally left and right over the cavity to open and close the cavity via tracks located on the blade head being perpendicular and proximate to the blower doors, wherein the blower doors are adapted to move along the track to yield open and closed configurations to open and close the aperture of the cavity. The one or more blower doors may instead/further comprise a hinged joint so that the doors are adapted to pivot open to channel snow into the aperture of the cavity and the blower unit.

Preferably, wing or wings are retractable directly, parallel and abutting behind the plow head blade to yield the closed position. The wing or wings are adapted to move by mechanical means, such as but not limited to tracks, rotary actuators, and/or sliding, pivoting or lifting mechanisms to extend laterally and parallel from the plow head blade on a horizontal plane, preferably perpendicular on a vertical plane or parallel on a horizontal plane, to yield varying open and extended position. Preferably, the wing or wings pivot on a hinge to extend laterally from the plow head blade on a horizontal plane to yield the open extended position. The wing or wings preferably include a pivot point laterally thereon adapted to pivot the wing or wings from the open extended position to an open extended pivot position in front of the plow head blade. It is contemplated that the wing or wings may extend and retract individually or at the same time on the surface of the plow head blade, or may pivot anywhere along the plow head blade, or may slide or pivot up or down on the plow head blade in an effort to direct snow, ice and other materials to any direction required for proficient snow removal purposes by either plowing, blowing and/or throwing. The snow blower unit is appointed to be powered by a power source such as hydraulic/pneumatic (air/fluid) power, internal combustion engine power, mechanical energy power, electrical energy power, chemical energy power, and electromagnetic energy power, and/or an engine of a vehicle. The blower unit may include a blower/thrower engine for powering the snow blower unit, wherein the blower/thrower engine preferably has a horsepower of at least about 1 horsepower (746 W).

Preferably, the blower unit includes a power source selected from the group consisting of hydraulic/pneumatic (air/fluid) power, internal combustion engine power, mechanical energy power, chemical energy power, and electromagnetic energy power.

The wing or wings may be retractable within an inner cavity in the plow head blade by mechanical means, such as but not limited to tracks, rotary actuators, and/or sliding, pivoting or lifting mechanisms. Alternatively, the wing or wings may be retractable within an inner cavity in the plow head blade along a track and wherein a pivot hinge is provided along the wing or wings. The one or more blower doors may be retractable along the plow head blade along a track and wherein a pivot hinge is provided along the blower doors so that the doors can also pivot. The one or more blower doors may be are retractable along the plow head blade either on a horizontal, vertical or a rotational motion action so the blower doors may be able to move either over a front or rear of the plow head blade so that the blower door can open, close, partially or completely, and pivot partially or completely.

The blower unit is preferably operative to perform a snow-blowing function and the plow is operative to perform a plowing function, and the snow-blower further comprises a specific/universal wired/wireless communication/controller device and switching means for starting and stopping operation of the snow blower, so that the snow blowing function and the snow plowing functions can be carried out concomitantly or independently of each other by the use of a specific/universal wired/wireless communication controller device, and/or a smart device type application. Switching means may be a specific/universal wired/wireless communication controller device with motor operative to operate the plow head blade, and the snow blower/thrower upon starting of the motor being further operative to move the one or more blower door to a the closed position when the switching means stops operation of the snow blower. Communications between the operator and the device may be by wired/wireless controller device whereby either utilizing a specifically engineered on-board wired/wireless controller device for the snow plow-blower apparatus' specific transport vehicle or a universal wireless communication/controller for all snow-plow-blower apparatus's for all transport vehicles using known electrical, electronic, infra-red, radio, and/or blue tooth type technologies for controlling & operating the snow plow-blower apparatus and all of its moving parts and embodiments individually or at the same time, and the wireless communications controller may be engineered by the use of a smart device's downloadable applications, or separate installations by authorized technicians/engineered training in the arts of such electrical, electronic, infra-red, radio, and/or blue tooth type technologies type applications.

The snow plow-blower may further comprise a versatility 360° chute having a standard chute, or a telescoping chute, or a folding chute where the device may blow/throw snow, ice and other materials in any direction required, including but not limited to, blowing/throwing directly into a back of a truck that the snow plow-blower apparatus operator is either operating and/or driving adjacent to an effort to clear a path from the snow, ice and/or other materials. Preferably, the snow plow-blower further includes at least four individual wheels/casters. A hydraulic and/electrically powered telescoping and/or folding chute is preferably included, electronically controlled using a wired or wireless controller. Preferably, the snow plow-blower includes one or more LED guides and a light bar.

In yet another embodiment, a snow plow-blower is provided having a plow head blade, an aperture and a cavity, one or more blower doors, a blower unit being at least one of a single stage or dual stage blower; and the blower door being adapted to move into closed and open configurations. Including, vertically upward, lift and pivot away, and rotate in a to expose the blower unit and transform the snow plow-blower from a snow plow either partially or completely. Preferably, the snow plow-blower includes one or more ribbon cutter, snow beater/screw-like, and/or conic-sectional-shaped device in order to initially process snow when the cavity is exposed.

BRIEF DESCRIPTION OF THE DRAWINGS

The invention will be more fully understood and further advantages will become apparent when reference is made to the following detailed description of the preferred embodiments of the invention and the accompanying drawing, in which.

DETAILED DESCRIPTION OF THE INVENTION

A snow plow-blower device offers improvements over heretofore disclosed and utilized snow plow devices. The subject snow plow-blower operates as a snow plow, snow blower, or as a snow plow-blower combination. Improvements include, for non-limiting example, improvements in the type of blower structure utilized, single or double stage, and single structural and single hydraulic designs, to enhance snow moving capability, decrease the size and weight of the apparatus and reduce overall manufacturing cost. Further improvements include incorporation of at least one individual wheels/casters, preferably at least three (3), and more preferably at least four (4) individual wheels/casters.

As used herein, vehicle shall mean, without limitation, truck, tractor, construction equipment, loader, skid steer, locomotives, or other powered/ride on device or machine capable of or operative to move snow and/ice, and/other materials. The term moveable machine refers broadly to walk behind or push snow blower, thrower or plow device that clear or moves snow and/or ice. Herein, snow blower and snow thrower are utilized interchangeably, unless otherwise stated.

As used herein the term "movable machine" means a self propelled or manually operable wheel/track machine other than a vehicle that the user can either Walk-behind and push, or Walk-behind with partial/full power-assist (e.g., self-propelled lawn mower/snow-blower/thrower/sweeper on wheels, or tracks) machine. Moveable machine refers broadly to walk behind or push snow blower, thrower or plow device that clears or moves snow and/or ice and/or other materials.

As used herein, the term "vehicle" shall mean, without limitation, truck, tractor, construction equipment, loader, skid steer, locomotives, or other powered/ride on device or machine capable of or operative to move snow and/or ice and other materials. The term "vehicle" further means a self-propelled wheeled or track machine, such as a Zero-Turn Radius Machine (ZTR), a Lawn Mower, Truck/Car, ATV/Utility ATV (All Terrain Vehicle/Utility All Terrain Vehicle), Skid-steer loader, Compact loader, Front-end loader (Pay-Loaders), Backhoe Front-End Loader, Dozer, Motor-grader, Specialty/Dedicated Vehicle/Machine, Off-Road Vehicle, and Trains/Locomotive).

Herein, the terms "snow blower" and "snow thrower" are utilized interchangeably, unless otherwise stated.

The snow plow-blower comprises a plow head blade having retractable/pivotal wing or wings and a cavity having an aperture with blower doors and a blower unit. The blower unit is preferably constructed as a single stage snow blower when a lighter snow plow-blower device is needed. Alternatively, the subject blower unit is a dual stage snow blower with impeller and auger features.

Figure 11:
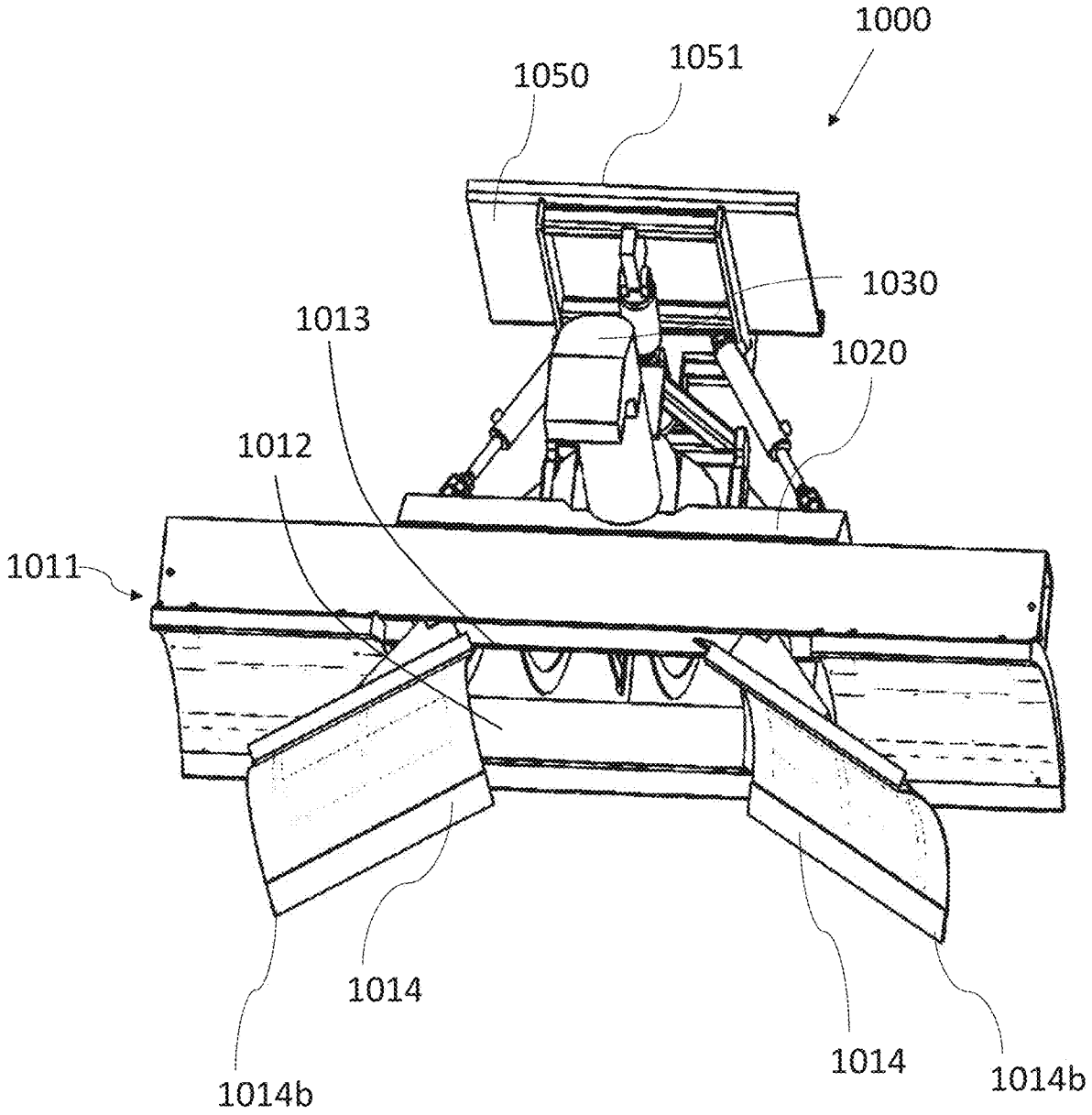
FIG. 11 illustrates a schematic view of another embodiment of the snow plow blower showing the blower doors open and pivoted to channel snow into the aperture and cavity with blower unit housed therein.

In one embodiment, the snow blower unit includes an impeller to move snow into the unit and force it out of a discharge chute. The snow blower unit can further include at least one auger. An engineered heating device can additionally be provided. The heating device may comprise a heat coil/element, placed strategically on, within or about the auger/or material cutting and/or processing embodiment's surface area to prevent packing and freezing of snow/ice, and other materials build up. Optionally, a mechanical scraper guide or electromechanical scraper guide can be provided. At least one blower door is provided over the snow blower unit cavity to prevent/ensure unwanted snow/ice/other materials, and especially animals/people from unintentionally entering the cavity when the blower is off. Optionally, the blower door moves along a track and rests flush against the plow head to open and close. Alternatively, the blower door is hinged mounted to pivot to open and closed positions. The blower door or doors may be controlled by hydraulics and may be constructed to operate as blower blades to direct snow into the blower unit as shown in FIG. 11; alternatively, separate blower blades are provided to optimize snow removal and mitigate jamming/clogging.

The present invention provides a snow plow-blower apparatus adapted to be used in operation with a land vehicle to plow and remove snow. Functionality of the blower and/plow can operate unilaterally or in conjunction with one another. Advantageously, the blower can be covered to prevent snow ingress when the blower is not being utilized. Additionally, the subject snow plow-blower apparatus provides secondary blades for directing snow as needed to mitigate and/or prevent clogging, unwanted snow distribution and/or snow pile placement.

The snow plow-blower apparatus comprises, in combination, a plow head blade which may include one or more wing located on the plow head blade. Preferably at least two wings located on opposing side walls of the plow head blade. The optional at least one wing is preferably retractable and/or have pivot means. In a first embodiment the snow plow-blower plow head blade includes an aperture leading to a cavity having an aperture with blower doors. Alternatively, in another embodiment the plow head blade does not have the aperture integrated therein, and the plow head blade itself is the blower door. In this embodiment, the plow head blade is operable to move upward and downward along the vertical plane to open and expose the aperture and visa vie the cavity (i.e. the aperture is essentially the opening to the cavity) and allow snow blowing operation.

In one embodiment the cavity is an opening directly leading to the auger for snow removal; in another embodiment the cavity is a sealed chamber whereby a vacuum system of snow removal can be employed with some minor engineering changes and optional parts. The cavity includes a snow blower unit housed therein. The cavity may or may not be a sealed chamber whereby a vacuum system of snow removal can be employed with some minor engineering changes and optional parts. The snow blower unit comprises at least one auger in communication with a power source adapted to move the snow into the unit and force it out of a discharge chute. Alternatively, the chute may rotate up to 360° (degrees) that permits the blowing of snow directly into the truck the device is mounted to as well as forward and adjacent trucks riding along the road during removal operations.

The subject snow plow-blower/thrower device may utilize a dual stage snow blower, single stage snow blower (or snow thrower), or a combination thereof. Generally, snow blowers are designated into two classes: single-stage and dual or two-stage snow blowers. The snow plow-blower shown herein is optionally designed to include a multi-stage blower apparatus, wherein generally more than two (2) moving parts may process and manage snow, ice/other materials. Typically, a single-stage snow blower includes a single snow moving part such as an auger, impeller, or sweeper-paddle-like mechanism, generally located in front of the blower, that pulls snow into the machine and directs snow through at least one (1) discharge chute and/or at least one (1) opening. Conversely, a two-stage snow blower typically includes both at least a single auger and an impeller, or sweeper-paddle-like mechanism that works in unison to pull or collect snow into or around the machine for processing and management, and then directs the snow through a discharge chute or opening. Two-stage snow blowers can typically process deeper snow depths than simpler single stage blower/thrower designs, and generally throw the snow faster and farther away than a single-stage snow blower/thrower. It is noted that the subject snow plow-blower can be utilized for blowing snow, ice and water, and/or particles and debris.

The plow head blade of the snow plow-blower may further include a moldboard, curved plate or outer covering made of a metal, steel, polymeric material or other suitable material which, together with a hinge located near the center of the moldboard, enables the plow head blade to open and transform to different shaped moldboard configurations. The moldboard configurations preferably include a straight blade, an angled blade, a scooped blade, a windrow blade, a wedge blade, a v-shaped blade and/or combination thereof.

The subject invention is preferably constructed as a single stage snow blower when a lighter snow plow-blower device is warranted. Generally, the subject snow plow-blower uses a single stage snow blower when weight constraints (weight limits) are of a concern, which are typically lighter in construct than the dual stage type snow blowers, particularly when mounting to transport vehicles. Single stage designs of impeller/fan blowers and/or throwers vs. dual stage designs of impeller and auger blowers and/or throwers are typically preferred by most manufacturers because it limits the number of moving parts thereby minimizing potential failure and increasing the integrity of its design to permit commercial/residential and/or industrial applications of greater longevity for the end user whereby effectively increasing consumer value.

Single stage structural implementation of the present snow plow-blower may further incorporate at least one (1) snow beater/ribbon cutter, or any combination of an engineered geometrical physical device, to be mounted to at least one (1) impeller/rotary fan and its central rotating shaft, versus a horizontal auger, because it is simpler to construct, easier to manufacturer, and is a lighter device, not requiring any maintenance (such as periodic lubrication so often found with augers). Typically, single stage blower hydraulic designs are simpler than dual stage because they require fewer hydraulic valves and controls for communications, permitting manufacturers to minimize potential hydraulic leaks mitigating mid-storm failures that readily occur in industry removal operations. The subject snow blower-blowers blower constructs offer improvements over heretofore designed and utilized snow plows/snow blowers and/or snow throwers, those improvements including the type of blower, single or double stage, and single structural and single hydraulic designs, to reduce overall manufacturing cost.

Further improvements result owing to the subject snow plow-blower, which further improvements include incorporation of at least one individual wheel/caster, preferably at least three (3) wheels/casters, and most preferably at least four (4) wheels/casters rather than the typical single wheel/caster type constructs. The subject snow plow-blower preferably utilizes at least one individual wheel/caster that is engineered in a manner to balance the weight of the device from its center of gravity, allowing users to attach and detach the device to transport the vehicle without the use of additional equipment or persons. Preferably at least four wheels/casters are utilized.

A hydraulic and/or electrically powered telescoping and/or folding chute is preferably utilized by the subject snow plow-blower, electronically controlled using a wired or wireless controller, rather than a standard (manual) chute. The wireless controller preferably uses infrared, radio and/or blue tooth technologies. The wired or wireless controller typically communicates with a switching device, preferably in communication with a specifically engineered switching device or box associated with the snow plow-blower apparatus attachment. Additionally, the subject snow plow-blower preferably includes larger pivoting wings on a hinge point at end of the plow head blade, wherein the wings can pivot up to 90 degrees without the need for the wings to retract into a cavity behind and/or within the plow head blade (moldboard) minimizing the wings mechanical moving parts, thus preventing potential failures and maintenance issues and enabling plow head blade (moldboard) to bucket snow, ice and/or other materials into the blower box more proficiently. Preferably, there is at least one wing having a length extending on the horizontal plane ranging from at least greater than one (1) inch; more preferably the length ranges from about four (4) to sixteen (16) inches or more; most preferably, the length ranges from about twelve (12) to thirty six (36) inches or more. For airport runway applications a considerable larger wing may be needed, such as ranging from about thirty-six (36) to one-hundred and twenty (120) inches or more may be needed. Preferably, there are at least two wing or wings, located opposite one another on the plow head blade. It is noted that the ranges can be scaled or otherwise adjusted to accommodate small/large moveable machines/vehicles.

The subject plow head blade has a varied radius of curvature to maximize the production of plowing function. Preferably, the radius of curvature ranges from about one (1) to sixty (60) inches; more preferably, the radius of curvature ranges from about four (4) to twenty four (24) inches or more; most preferably the radius of curvature ranges from ten (10) to sixteen (16) inches. It is noted that the ranges can be scaled or otherwise adjusted to accommodate small/large moveable machines/vehicles.

The plow head blade curvature facilitates in permitting the end user to utilize the plowing function as a high production municipal plow at faster speeds providing greater windrowing (roll) of snow, ice and/or other materials versus slower speeds and control of snow windrowing (roll) useful depending on the density of snow, ice and/or other materials. Articulation of the moldboard and plow head blade and blower box behind it facilitates windrowing/attack angle of the snow. Windrowing/attack angle of the plow head blade is at various angles, limited only by physical constraints/practical limitations, i.e., 35 degrees, whereby permitting the end user to windrow and manage the blowing of snow more proficiently while in semi-plowing-blowing/throwing mode. Windrowing angles are effectuated by turning the whole moldboard or plow head blade, and preferably range from about one (1) to seventy (70) degrees; more preferably range from about ten (10) to sixty-five (65) degrees; and most preferably range from about twenty five (25) to fifty (50) degrees, with about thirty five (35) degrees being the most preferred angle. Guides are typically used on plows and blowers, preferably manual mechanical guides. LED guides may also be included via integrated or subject to attachment to the plow head blade of the subject snow plow-blower. A light rail portion of a light tower is typically used to mount headlights for plows and/blowers. In addition, a LED light bar may be used with the snow plow-blower, and more preferably a light rail portion of a light tower with an LED light bar may be also integrated or attached to the plow head blade of the subject snow plow-blower.

The blower doors are adapted to move into closed and open configurations. The blower doors are positioned over the snow blower unit cavity to prevent snow from entering the cavity when the blower is off. Optionally, the blower doors move along a track and rest flush against the plow head to open and close. Alternatively, the blower doors are hinged mounted to pivot to open and closed positions. The blower doors may be constructed to operate as blower blades to direct snow into or away from the blower unit. Alternatively, separate blower blades, external to the snow blower cavity, are provided to optimize snow removal and mitigate jamming/clogging. In one embodiment, tracks are located on the blade head perpendicular and proximate to the blower doors. Moving along the track, the blower doors are adapted to provide open and closed configurations to open and close the aperture of the cavity. Preferably, the tracks are flush against the blade head so that the blower doors lay substantially flat or flush against the blade head. The blower doors may further comprise a hinged joint so that the doors are adapted to pivot open appointed to channel snow into the aperture of the cavity and the blower unit. Alternatively, separate blades/wings may be provided proximate and adjacent to the blower doors.

In another embodiment, the snow blower doors and/or wings further comprise a hinged joint so that the doors and/or wings are adapted to pivot open to channel snow into or away from the aperture of the cavity and the blower unit, thereby providing the end user an efficient means for proficient snow, ice and/or material management.

Preferably the cavity having the aperture with the blower doors is located substantially centrally along the plow head blade.

The blower unit of the snow plow-blower apparatus is appointed to be powered by an engine of a vehicle via hydraulic fluid power hook-up to the vehicle or tractor. Alternatively, the snow plow-blower apparatus includes a blower engine integrated within the blower unit for powering the snow blower unit. Power for the device isn't limited only to hydraulic power, but can, and may be utilized using one or many forms of energy transfer, or power. The energy transfer, or delivery of power can be obtained by the employment of Pneumatic (air/fluid) Power, Internal Combustion Engine Power (i.e., gasoline, diesel, bio-diesel, natural gas, and/or hybrid engines), Electrical Power, Mechanical Energy (direct physical linkage) Power, such as a Power Take Off (PTO), Chemical Energy Power, and/or Electromagnetic Energy Power. Horsepower of the blower engine may vary according to the commercial size/requirements necessary. For example, for a commercial or municipality commercial grade device, the blower engine should be enough horsepower to accommodate large projects. Different geographical areas will further require greater horsepower and/supplementary scaled engineering to address the snowfall and accumulation specifics for a region. For residential devices, a lower horsepower may be used with supplementary scaled engineering.

Though the device herein is discussed in terms of attachment to a vehicle, such as a truck, bulldozer or tractor, it should be understood that this device may be adaptable to fit on to other movable machines and/or vehicles (large and small); such as lawnmowers (i.e., Toro, Honda, Craftsman), ATV/Utility ATV's, road-vehicles, utility sidewalk traveling vehicles, winter service vehicles, railcars and trains, skid-steer (i.e., bobcat), backhoes, backhoe-loader, backhoe-loader-tractor, Pay loaders and Front end-loaders (i.e., Caterpillar), or any combination of large or small earthmoving type equipment, i.e., motor graders, tractors and bulldozers. Accordingly, the device may be of such a size and construct so that it can be readily attached to a small tractor or lawnmower for residential snow removal.

The wing or wings preferably retract or pivot in line/behind the plow head blade when the wings are disengaged, no longer needed, or when the blade needs to be of a shorter width to fit into smaller plowing areas (i.e. small driveways, parking lots, and the like). Preferably, the at least one wing is on pivot hinges, wherein the hinges provide pivot of at least 90 degrees in front of the plow head blade and at least 90 degrees behind the plow head blade. Optimally, the wing or wings each have separate wing controls so that each can be pivoted separately. With this arrangement, each of the wing or wings can be adjusted to different angles and degrees in relation to one another and in relation to the plow head blade.

The blower blades (or blower doors depending on the embodiment) are on pivot hinges. These pivot hinges provide a pivot range of at least 180 degrees in front of the plow head blade Like the wing or wings, the blower blades each have separate blower blade controls so that they can be pivoted separately. In this manner, the blower blades can be adjusted to different angles and degrees in relation to one another and in relation to the blower unit and the plow head blade.

Figure 1A:
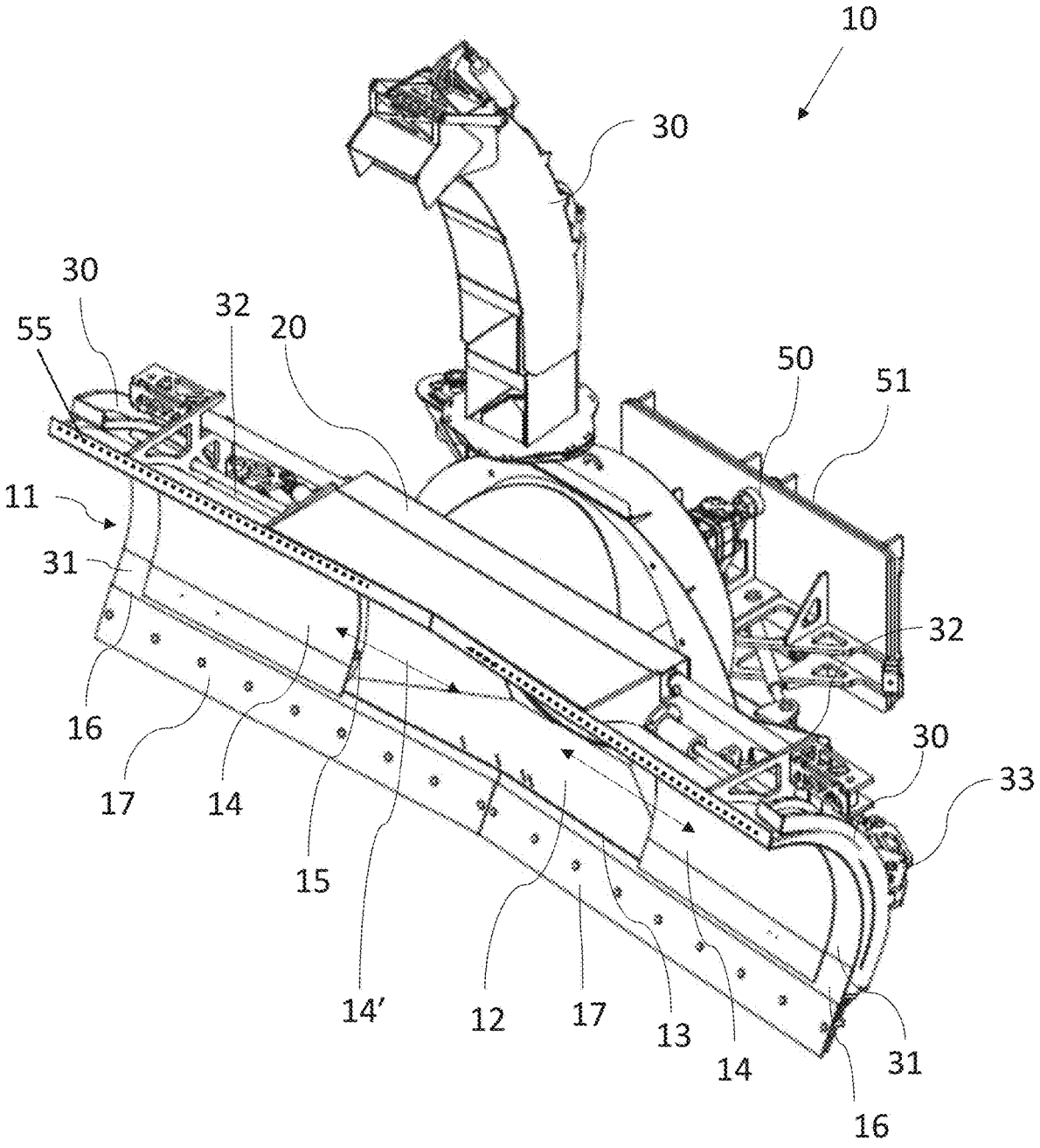
FIG. 1*a* illustrates a schematic view of an embodiment of a plow assembly of the snow plow-blower with blower doors in an open configuration exposing a snow-blower cavity, and the wing or wings in a retracted configuration.
Figure 1B:
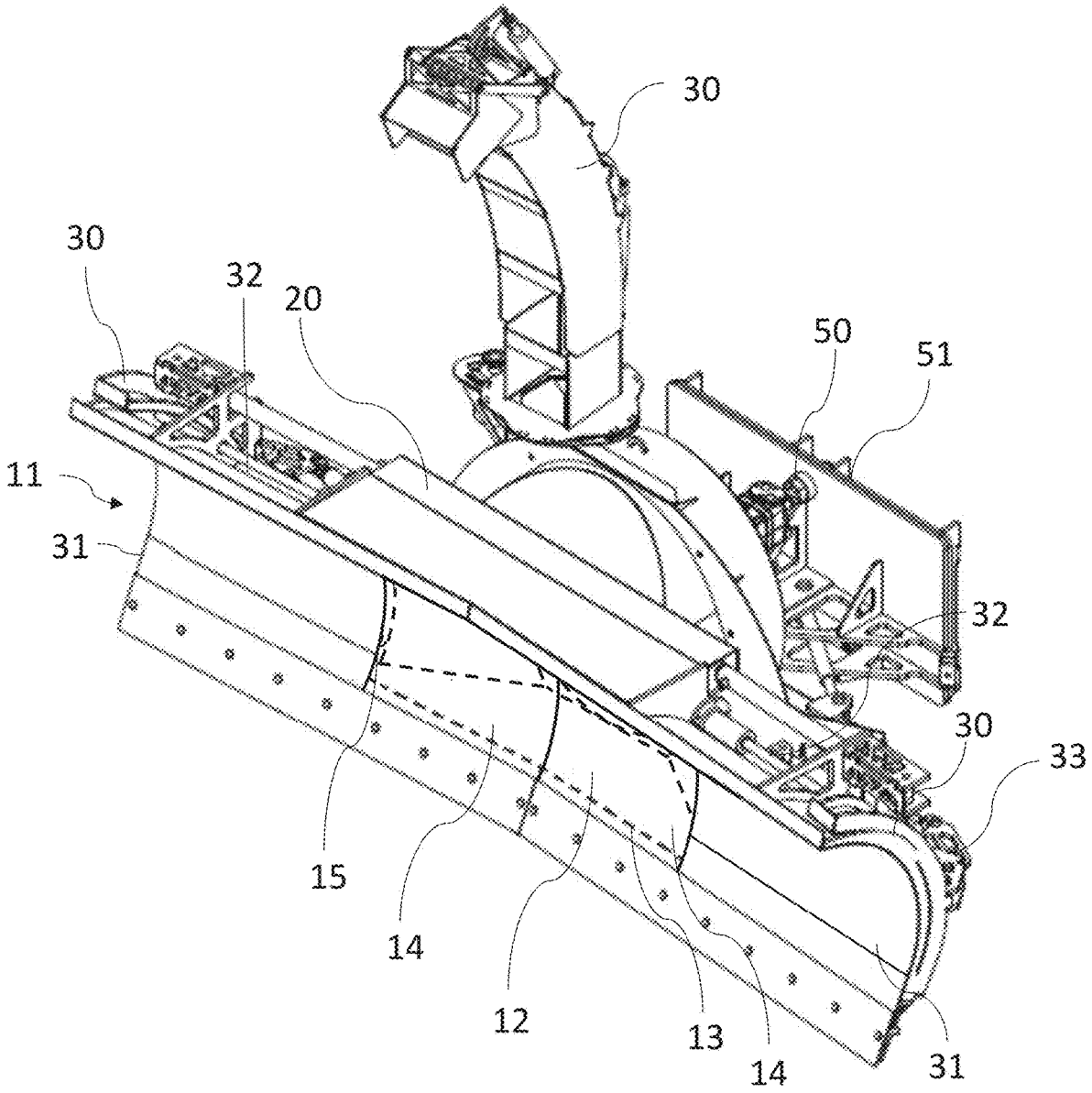
FIG. 1*b* illustrates the schematic view of FIG. 1*a* with the of blower doors in a closed configuration closing the snow-blower cavity, and the wing or wings in the retracted configuration.

Referring to FIGS. 1*a*-1*b*, there is shown generally an embodiment of a snow plow-blower apparatus of the present invention appointed to be mounted on a vehicle/machinery or other carrier device. FIG. 1*a* illustrates a schematic view of an embodiment of a plow assembly of the snow plow-blower with blower doors in an open configuration exposing a snow-blower cavity, and the wing or wings in a retracted configuration, shown generally at 10. FIG. 1*b* illustrates the schematic view of FIG. 1*a* with the of blower doors in a closed configuration closing the snow-blower cavity, and the wing or wings in the retracted configuration.

In the embodiment shown in FIGS. 1*a* and 1*b* the snow plow-blower 10 generally includes a plow head blade 11 with a cavity 12 integrated therein, preferably centrally, having an aperture 13 with blower doors 14. FIG. 1*a* shows the blower doors 14 in an open configuration, exposing/opening aperture 13 and cavity 12. Cavity 12 includes a snow blower unit 20 integrated and housed therein. FIG. 1*b* shows the blower doors 14 in a closed configuration, preferably completely sealing shut aperture 13 and cavity 12 so that no snow, ice and water, particles or debris can enter cavity 12 and visa vie snow blower unit 20. Snow blower unit 20 is in communication with a power source and is adapted to move snow, ice and/water, and/or other materials through the snow plow-blower 10 and force it out of at least one discharge chute 30 and/or at least one opening.

Figure 9A:
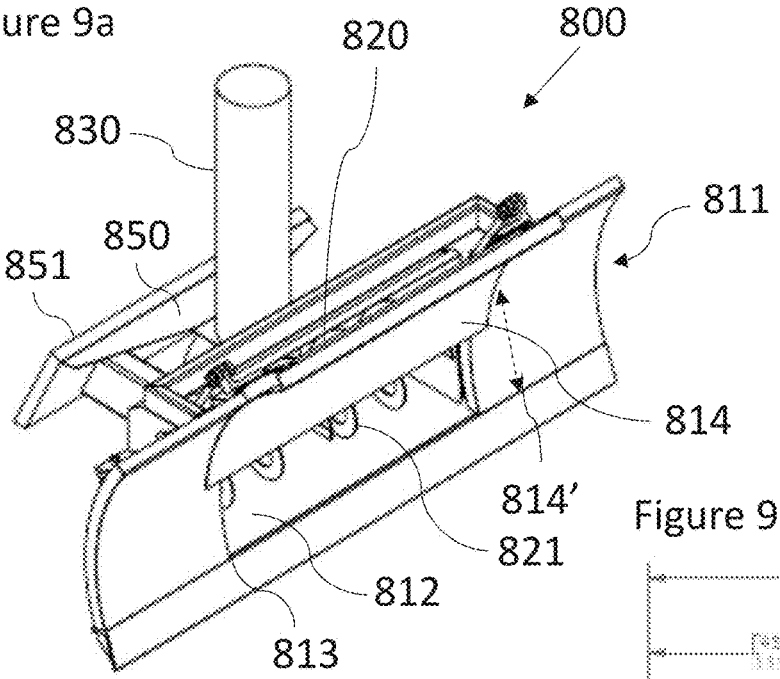
FIG. 9*a* is a front-axonometric view of an embodiment of the subject snow plow-blower showing a single blower door that opens and shuts on the vertical plane and a dual stage blower.

The blower doors 14 are adapted to move into open and closed positions/configurations, as shown in FIGS. 1*a* and 1*b*, respectively. In one embodiment, blower doors 14 are adapted to move as one with sliding rods in and out of door alignment housing/structural stiffeners/tracks, shown generally at 15 of the plow head blade 11 so that the blower doors 14 can move laterally or horizontally along the horizontal plane as indicated at arrows 14'. Alternatively, as shown in FIG. 9*a*, blower doors 814 may be constructed with mating tongue and groove/or tracks with the plow head blade 811 configured on the vertical plane so that the blower doors 814 can move upward (opening cavity 812) and/downward (closing cavity 812) along the vertical plane. Referring to FIGS. 1*a* and 1*b*, two blower doors 14 are shown, however, the doors may be constructed of more than two blower doors 14 and may be operative to slide or move in a rotational or linear direction. Alternatively, the blower doors 14 may be formed as a single door that covers aperture 13 and cavity 12.

Blower doors 14 are adapted to move from the open configuration to the closed configuration, thereby completely closing and preferably sealing aperture 13 of cavity 12 and preventing all snow, ice, water or/and other material ingress into the snow blower 20 when the snow blower 20 is not being utilized. In one embodiment, blower doors 14 may pivot outward from the plow head blade 11 to further channel snow, ice and debris into cavity 12 and the snow blower 20.

Plow head blade 11 of the snow plow-blower apparatus 10 is preferably attached to a pivot hinge weldment 50 (i.e. weld unit formed by welding together an assembly of pieces), which in turn is attached to a wobble plate weldment 51 for mounting to a vehicle or moveable machine, or other mechanical implement.

Plow head blade 11 further includes two wings 30, each located on opposing side walls 31 of the plow head blade 11. Wings 30 are shown in the retracted or closed configuration in FIGS. 1*a* and 1*b*.

Wing or wings 30 are retractable in relation to the plow head blade 11. Preferably, wings 30 are stowed behind plow head blade 11 and retract/extend due to moveable weldments 132 and 132' of FIG. 2*a*, or moveable weldment 506-509 of FIG. 6*c*, or moveable weldment 600 of FIG. 7*a*, so that the wings 30 slide laterally outward from behind the plow head blade 11. In another configuration, (shown in FIG. 4*a*) the plow head blade 11 is literally continued for the lateral length of each of the wings 30 to enlarge the plow head width and height dimensions. In yet another embodiment, the wings 30 may be retractable/extend from an inner cavity of the plow head blade via track and groove, so that the wings 30 travel on an inner track into the inner cavity to be stowed away, forming a pocket-scoop door type configuration. In this embodiment, the wings 30 extend or slide outward from the channel or pocket to open, and conversely retract into the channel or pocket when closed or stowed away for non-use.

Trip edges (left and right) 16 are located on the bottom of the plow head blade 11 as well as along the bottom-most edge of the blower doors 14 and wings 30. The plow head blade further preferably includes a bottom-most scraper blade or replaceable cutting edge (left and right) 17. One or more material scraper(s) may be attached or integrated on the plow head blade 11, preferably attached laterally/above the plow head blade 55, or to the side walls of plow head blade 31 (i.e., mold board top 55 and side edge 31). One or more LED guides or a light bar may be attached or integrated on the plow head blade, as shown at 30. Preferably one or more light bars may be attached or integrated on top of snow blower 20. A light bar configuration can also be mounted to wobble plate assembly 51 and a vehicle or movable machine receiver mount/hitch such as a truck mount (not shown).

Figure 2A:
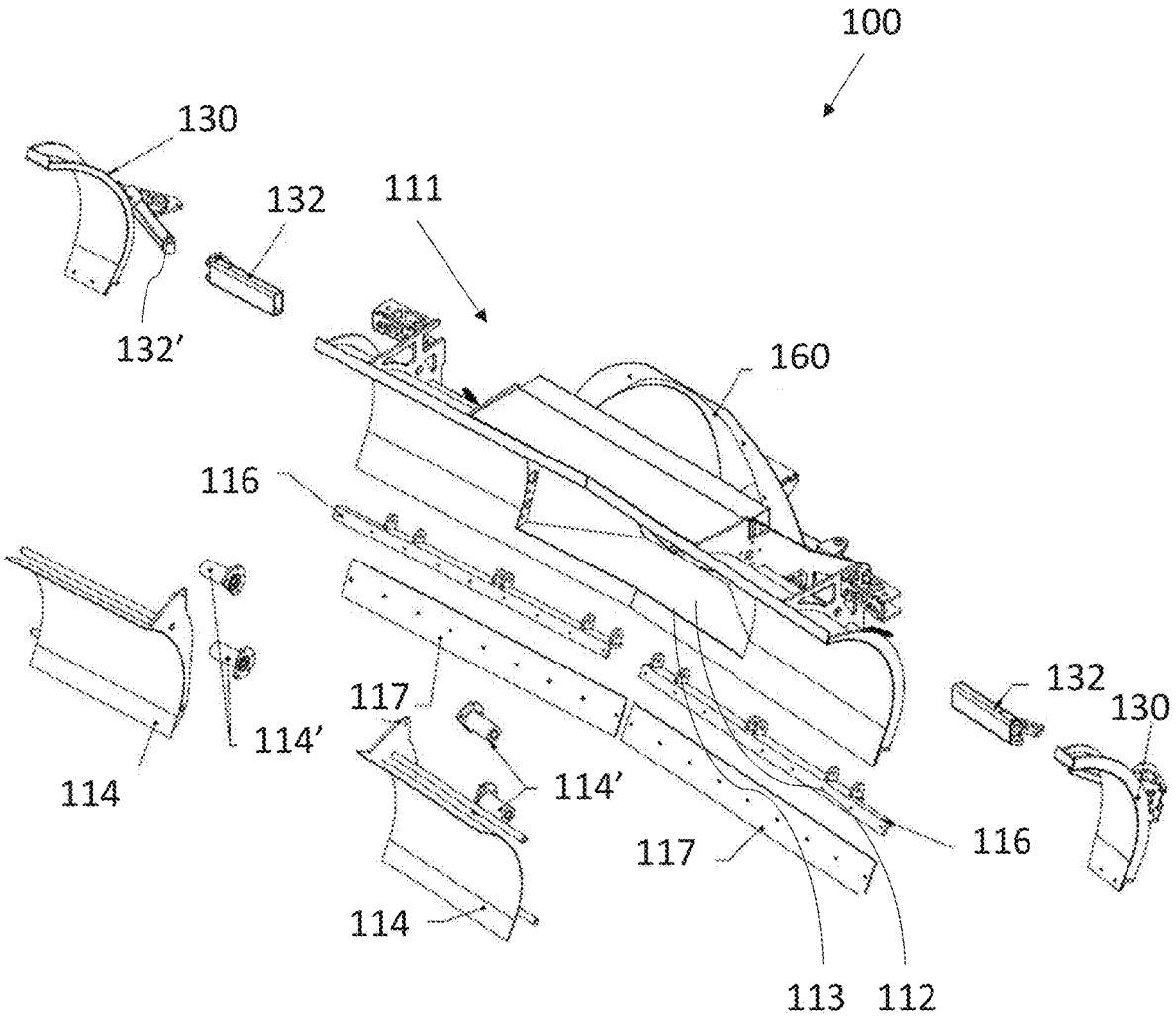
FIG. 2*a* is an exploded view illustrating parts of the assembly of the plow head blade of FIG. 1*a;*
Figure 2B:
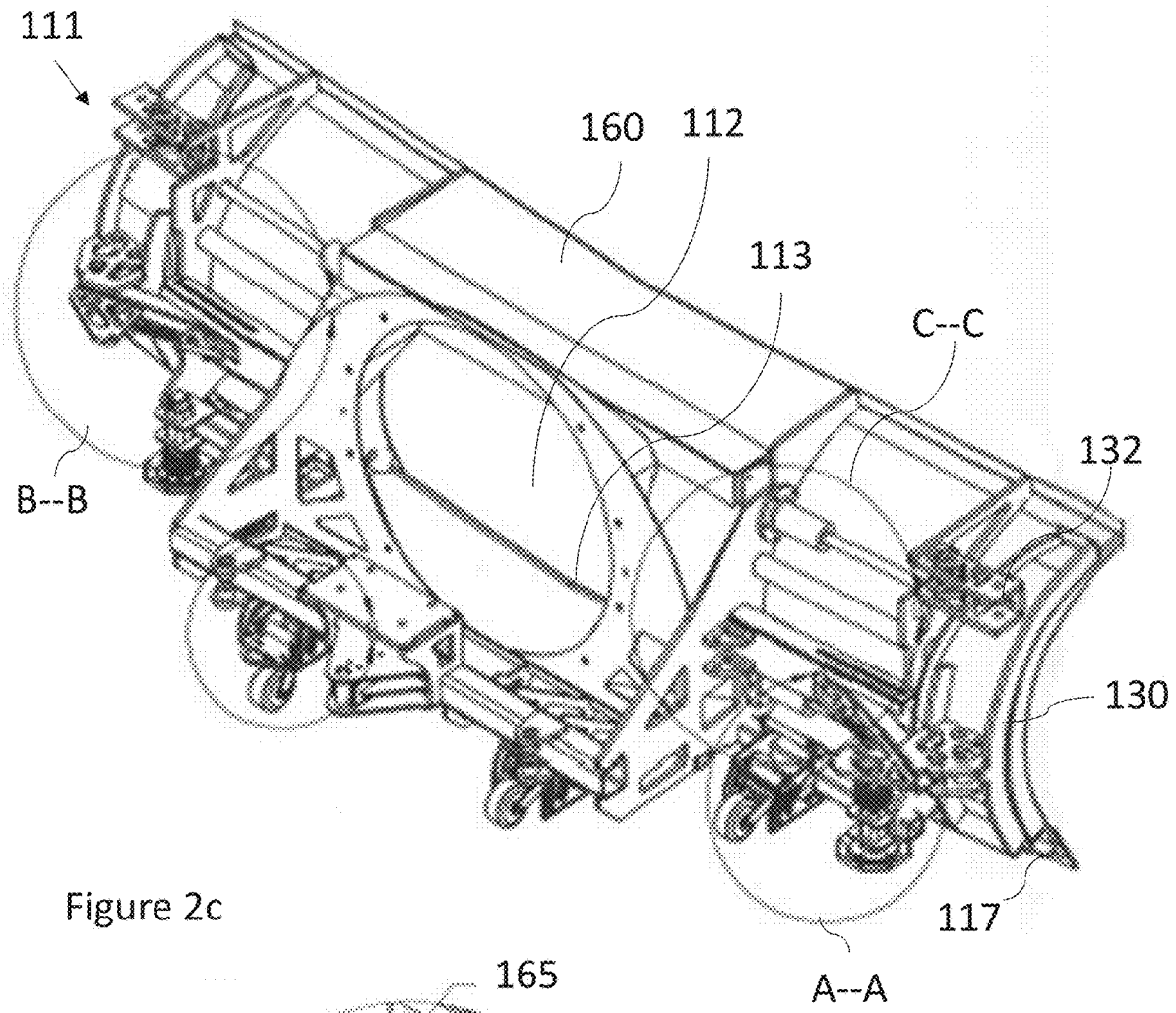
FIG. 2*b* illustrates a schematic back view of parts of the assembly of the plow head blade of FIG. 1*a;*
Figure 2C:
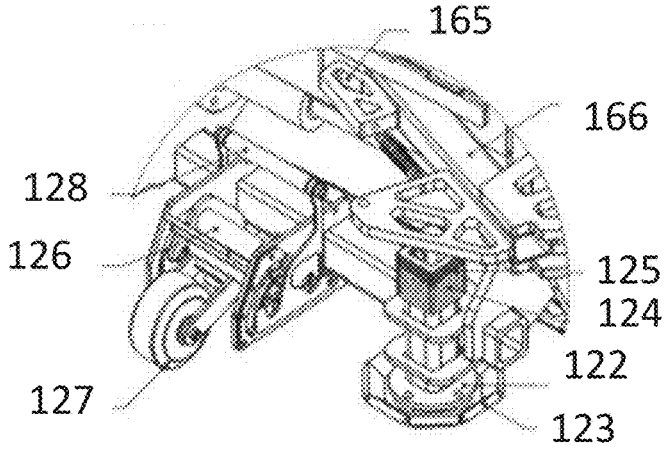
FIG. 2*c* illustrates a cross-sectional view taken at A-A showing a swivel caster wheel assembly on the snow plow blower assembly.
Figure 2D:
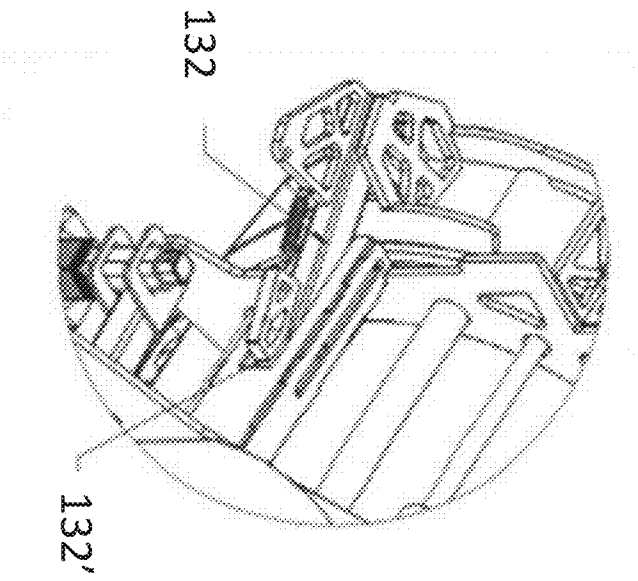
FIG. 2*d* illustrates a cross-sectional view taken at B-B showing a view of the left-wing weldment and wing slide tube weldment.
Figure 2E:
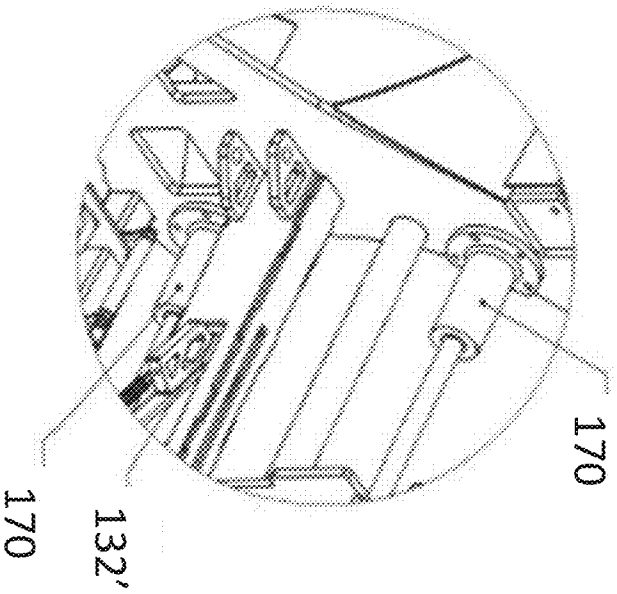
FIG. 2*e* illustrates a cross-sectional view taken at C-C showing a view of the door alignment housing assembly.

FIGS. 2*a*-2*b* illustrate the plow head blade assembly of FIG. 1*a*. FIG. 2*a* illustrates a schematic front view of parts of the plow head blade assembly of FIG. 1*a*, shown generally at 100. FIG. 2*b* illustrates a schematic back view of parts of the assembly of the plow head blade of FIG. 1*a*. FIG. 2*c* illustrates a cross-sectional view taken at A-A showing a swivel caster wheel assembly on the plow head blade apparatus. FIG. 2*d* illustrates a detailed view taken at B-B showing a view of the left-wing weldment and wing slide tube weldment. FIG. 2*e* illustrates a detailed view taken at C-C showing a view of the door alignment housing weldment assembly 170 of FIG. 2*e* and moveable wing weldment 132.

Referring to FIGS. 2*a*-2*e*. Plow head blade 111 is preferably formed via plow structural frame weldments: 403-405, 414 of FIGS. 5*b*, 403-405, 408, 414 of FIG. 5*c* and 403-406 of FIG. 5*d* and 503-505 of FIG. 6*b*, or a unit formed by welding together an assembly of pieces and includes an aperture/opening 113 and a cavity 112 adapted to house a snow blower unit. Left and right blower doors 114 weldments are preferably formed and adapted to be mounted on plow head blade 111 via door alignment housing weldment assembly 114'. Left and right trip edge/blade assemblies, 116, are mounted on plow head blade 111, and structural frame weldment 414 of FIG. 5*b*. In turn, a replaceable scraper blade/edge 117 is mounted on the left and right trip edge blades 116. Wing slide tube weldments (left and right) 132 are formed as grooves or rectangular or tubing elements adapted to receive a tong/tongue/tube insert 132' of a wing 130 so that the wing 130 can retract and/or extend from slide tube weldments 132 mounted on plow head blade 111 for lateral extension/retraction positions of the wings 130 from the plow head blade 111. FIG. 2*c* illustrates a cross-sectional view taken at A-A showing a swivel caster wheel assembly on the plow head blade. Preferably, at least four (4) swivel caster wheel assemblies are mounted on the plow head blade 111. Wing slide tube weldment 165 and right (and left) wing weldment 166 are mounted on plow head blade 111. Skid shoe leg-plate weldment 122, skid shoe weldment 123, skid shoe shim 124, skid shoe thin shim 125, caster wheel mount weldment 126, swivel caster 4 in polyurethane wheel 127, which can alternatively be comprised of steel, rubber or other suitable material, and front caster lock assembly 128 are assembled to form the swivel caster wheel assembly. FIG. 2*d* illustrates a detailed view taken at B-B showing a view of the (left) wing weldment 132 and wing slide tube weldment 132'. FIG. 2*e* illustrates a detailed view taken at C-C showing a view of the door alignment housing assemblies 170 and wing slide tube weldment 132'.

Figure 3:
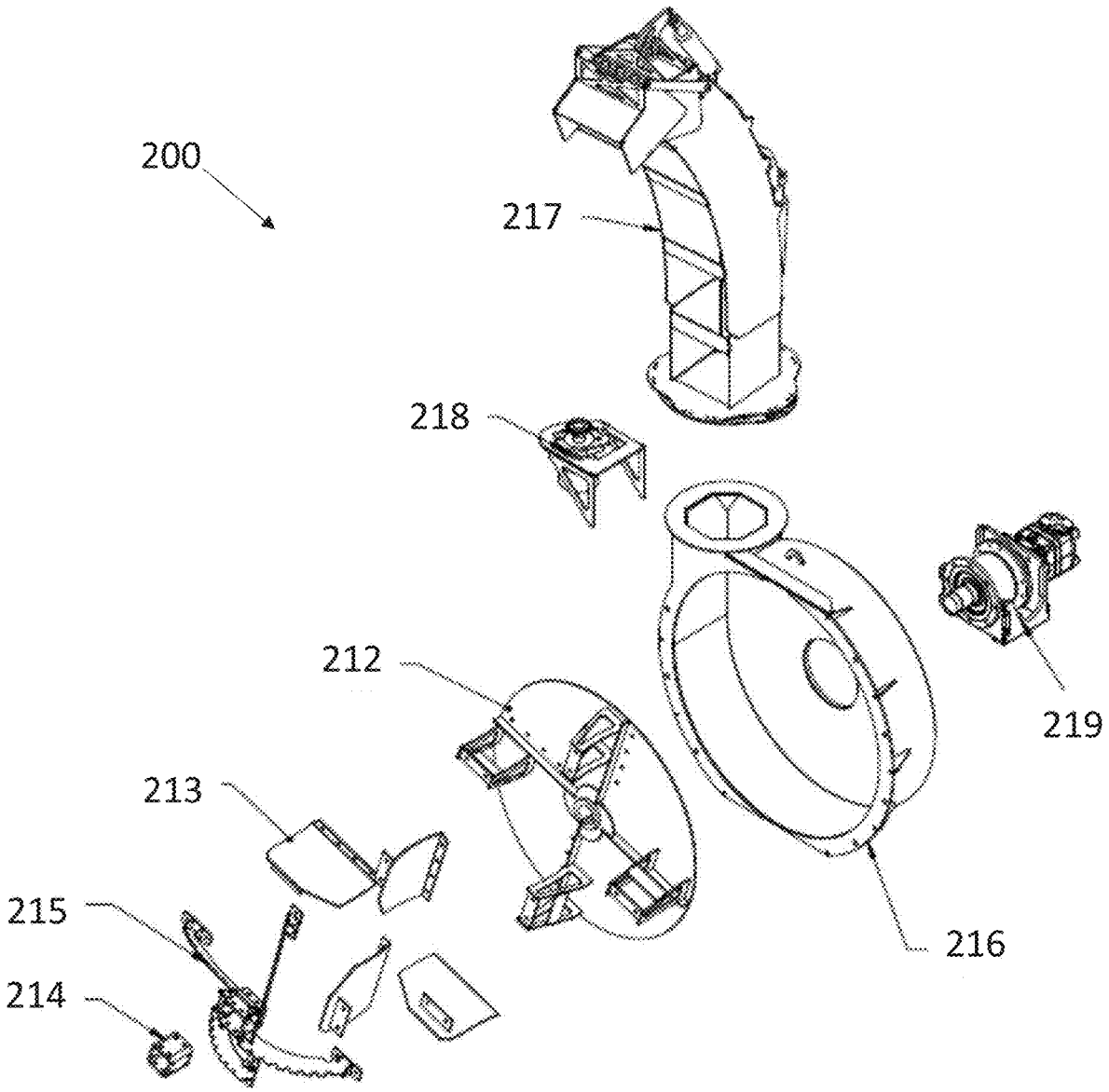
FIG. 3 is an exploded view illustrating parts of the assembly of a rotary blower of an embodiment of a snow plow-blower of the subject invention.

FIG. 3 illustrates an exploded front isometric view of parts of the assembly of a blower of an embodiment of a snow plow-blower of the subject invention, shown generally at 200. Blower 200 assembly is preferably constructed having a telescoping chute assembly 217 mounted in association with a chute motor mounting assembly 218 and hydraulic motor drive assembly 219. A volute weldment 216 houses chute motor mounting assembly 218, motor drive assembly 219, and fan weldment 212 with preferably 8 in fan blade weldment 213, fan knockdown center connector 214 and fan knockdown blade weldment 215.

Figure 4A:
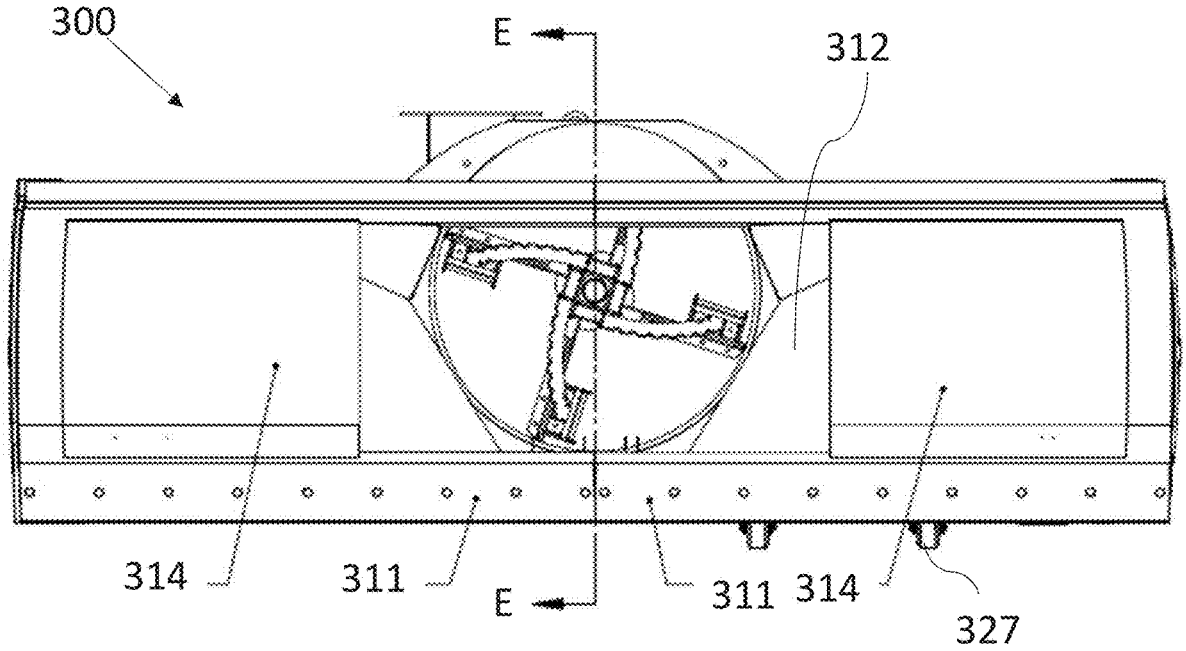
FIG. 4*a* illustrates a front view of the single stage plow head blade assembly.
Figure 4B:
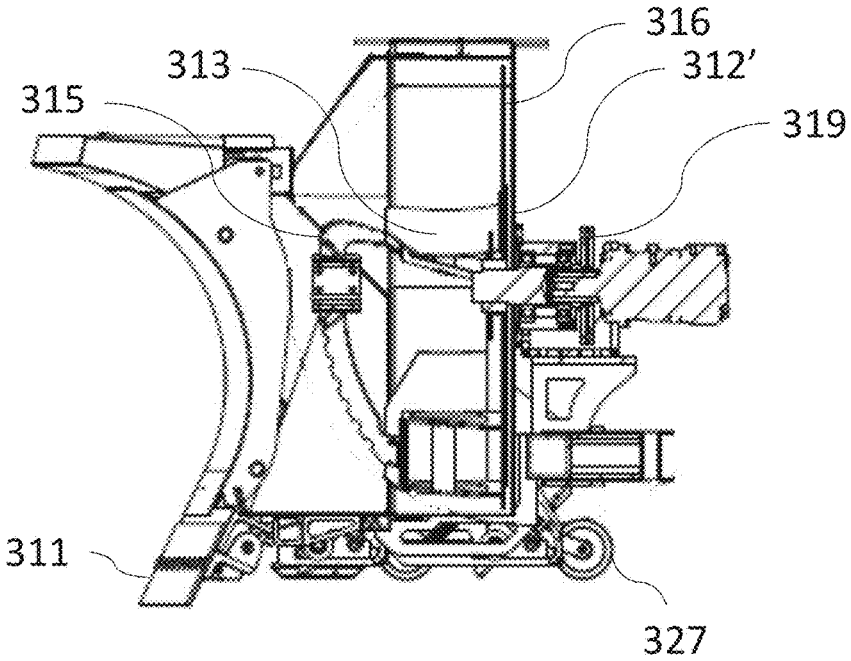
FIG. 4*b* illustrates a cross-section side view taken at E-E of FIG. 4*a;*

FIGS. 4*a*-4*b* illustrate constructs of the plow head blade assembly. FIG. 4*a* illustrates a front view of the plow head blade assembly, shown generally at 300. FIG. 4*b* illustrates an exploded cross-section side view taken at E-E of FIG. 4*a*. Plow head blade 300 includes left and right blower doors 314 preferably formed via weldment. A scraper blade or replaceable cutting edge 311, preferably a left and right scraper blade, is mounted on the bottom edge of the plow head blade 300. Caster wheels 327 (at least one and preferably four) are located on the rear of the plow head blade 300 and/or bottom of the blower box-plow frame weldment. Plow head blade includes a cavity 312, shown exposed as the blower doors 314 are in the open configuration. Cavity 312 houses therein a blower unit generally including a fan weldment 312', an 8 in fan blade weldment 313, a fan knockdown blade weldment 315, a volute weldment 316 and a hydraulic motor drive assembly 319. Fan knock down blade weldment 315 constitutes a snow moving part which is, optionally, attached to a telescoping shaft and of which the snowbeater is comprised.

Figure 5A:
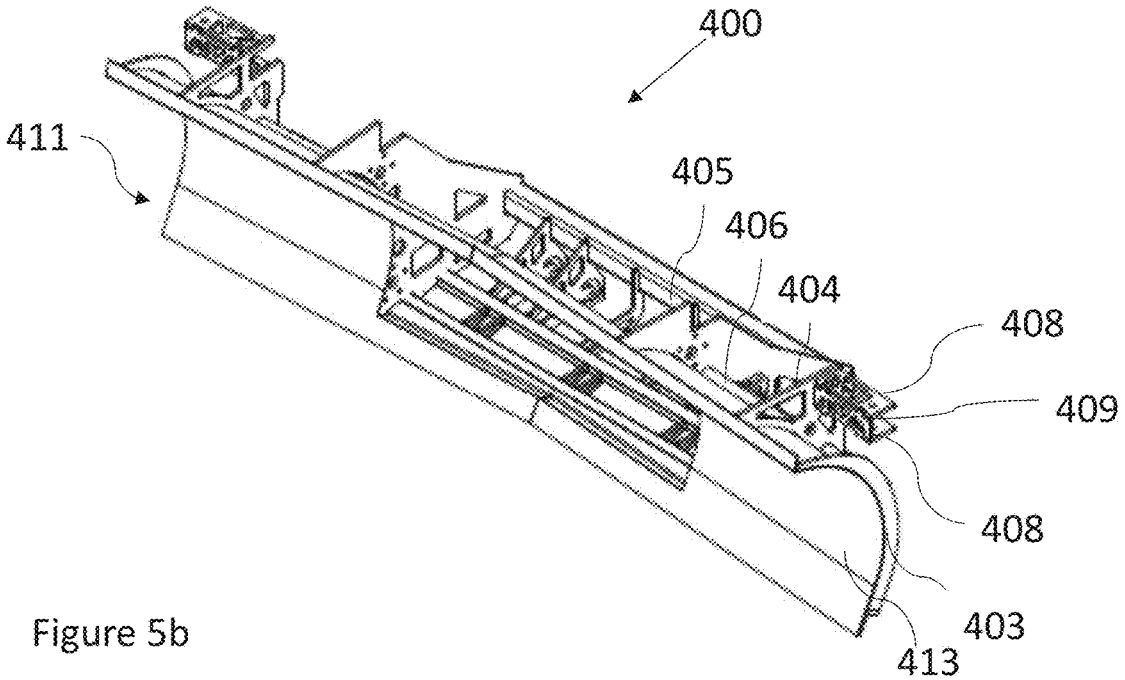
FIG. 5*a* is a front, axonometric view illustrating the left and right wing of the plow head blade frame weldment.
Figure 5B:
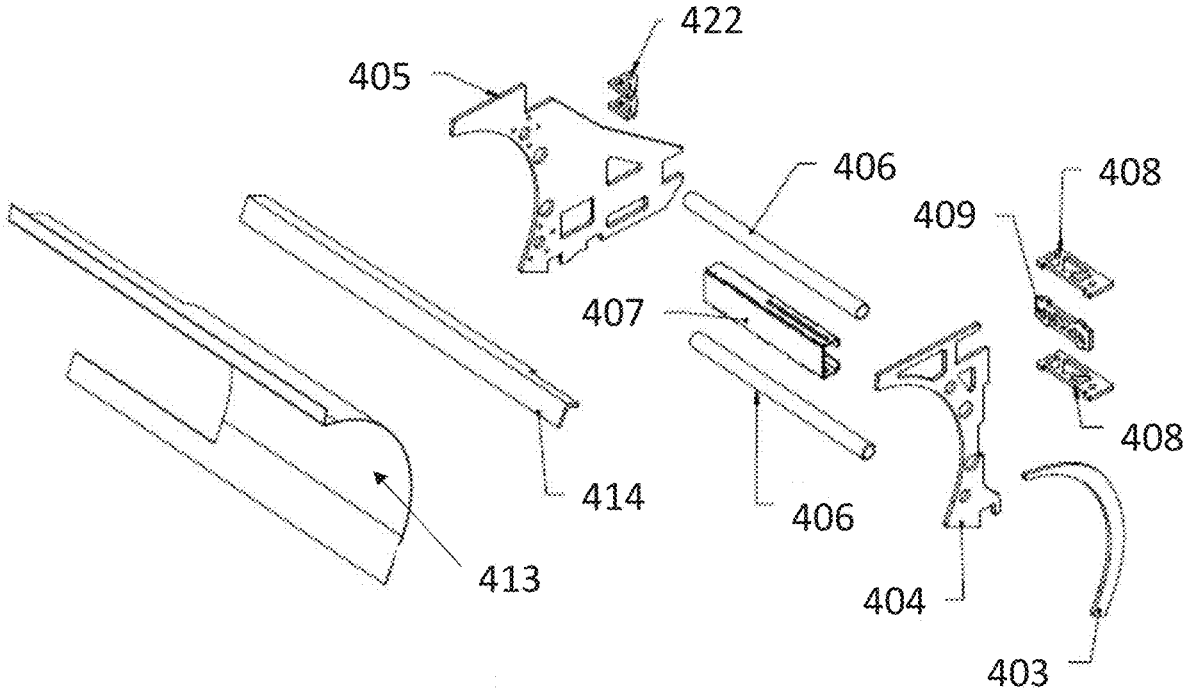
FIG. 5*b* is an exploded view illustrating the left side of plow head blade assembly of FIG. 5*a;*
Figure 5C:
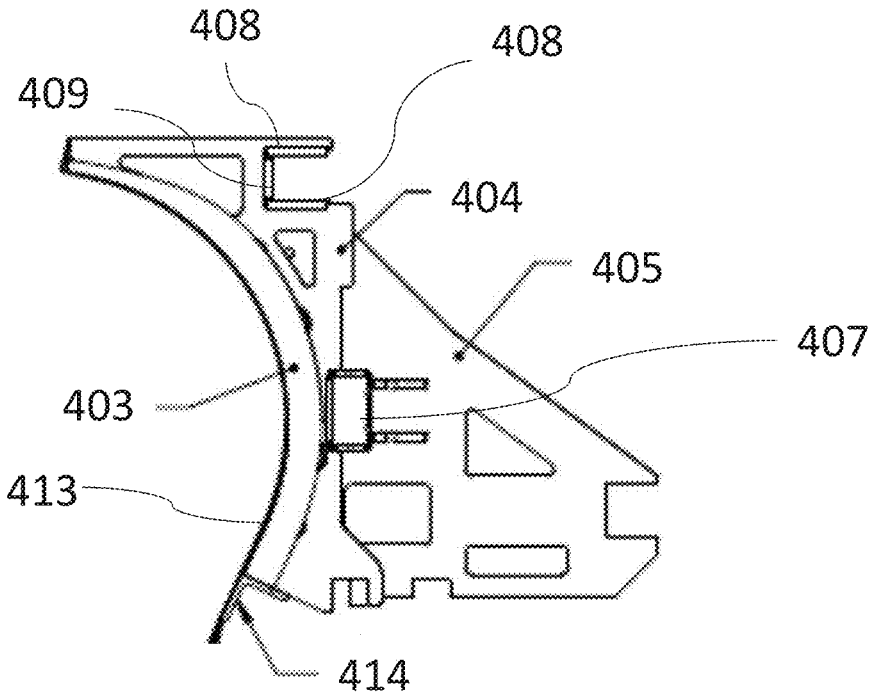
FIG. 5*c* is a side view illustrating a portion of a ribbed mold board.
Figure 5D:
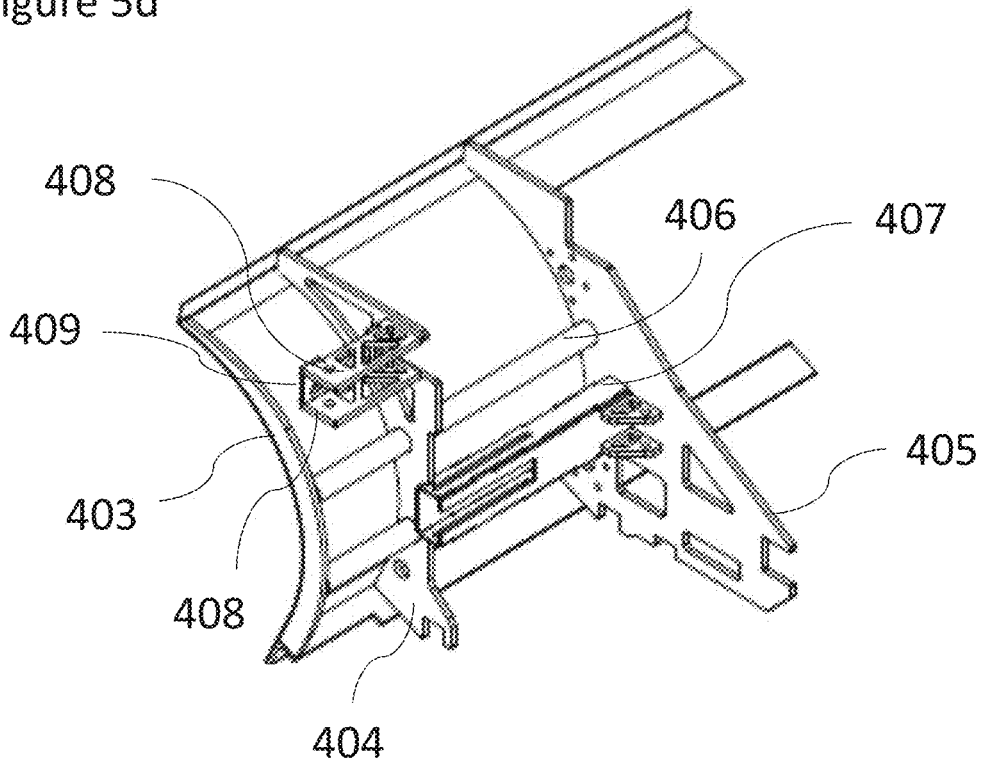
FIG. 5*d* is a rear-axonometric view illustrating the plow head assembly of FIG. 5*a;*

FIGS. 5*a*-5*d* illustrate the assembly of an embodiment of the plow head blade, showing the (left) wing construction of the plow head blade. It is noted that the right-wing construction corresponds to the left-wing construction, welded or attached together to form the plow head blade assembly. FIG. 5*a* illustrates a front, axonometric view of the left and right wings of the plow head blade frame weldment, shown generally at 400. FIG. 5*b* illustrates a parts assembly exploded view of the wing assembly of FIG. 5*a*. FIG. 5*c* is a left-side view of FIG. 5*a*. FIG. 5*d* is a rear axonometric view illustrating the plow head assembly of FIG. 5*a*. Wing assembly (left shown) 400 mounts with the right-wing assembly to form the plow head blade, partially shown at 411. Plow head blade (partially shown/left wing assembly shown) is constructed having a cavity 412 opening (partially shown) formed in a (left) moldboard 413 flush mounted on a left frame angle 414. A plow frame blower box rib 405 is mounted in the back of the moldboard 413. Wing slide tube weldment 407 and frame stiffener pipes 406 are mounted on one side to plow frame blower box rib 405 with door cylinder mount plate 422, and on the opposing side to a plow frame center rib 404. A plow frame outer rib 403 is mounted to the moldboard 413. Wing or wings (not shown in this figure; see FIG. 1*a*) are mounted to plow frame center rib 404 by door cylinder mount top and bottom 408 and door cylinder mount back 409.

Figure 6A:
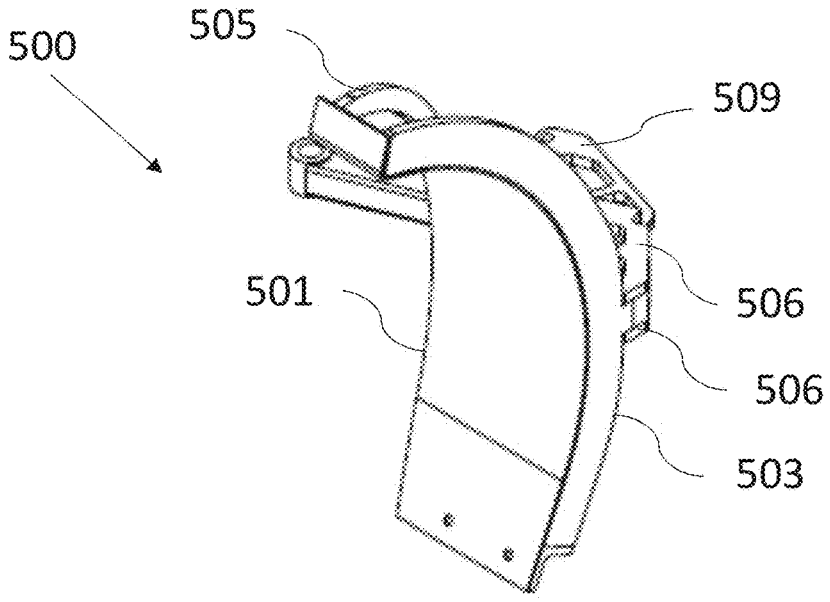
FIG. 6*a* is a front-isometric view of a wing assembly.
Figure 6B:
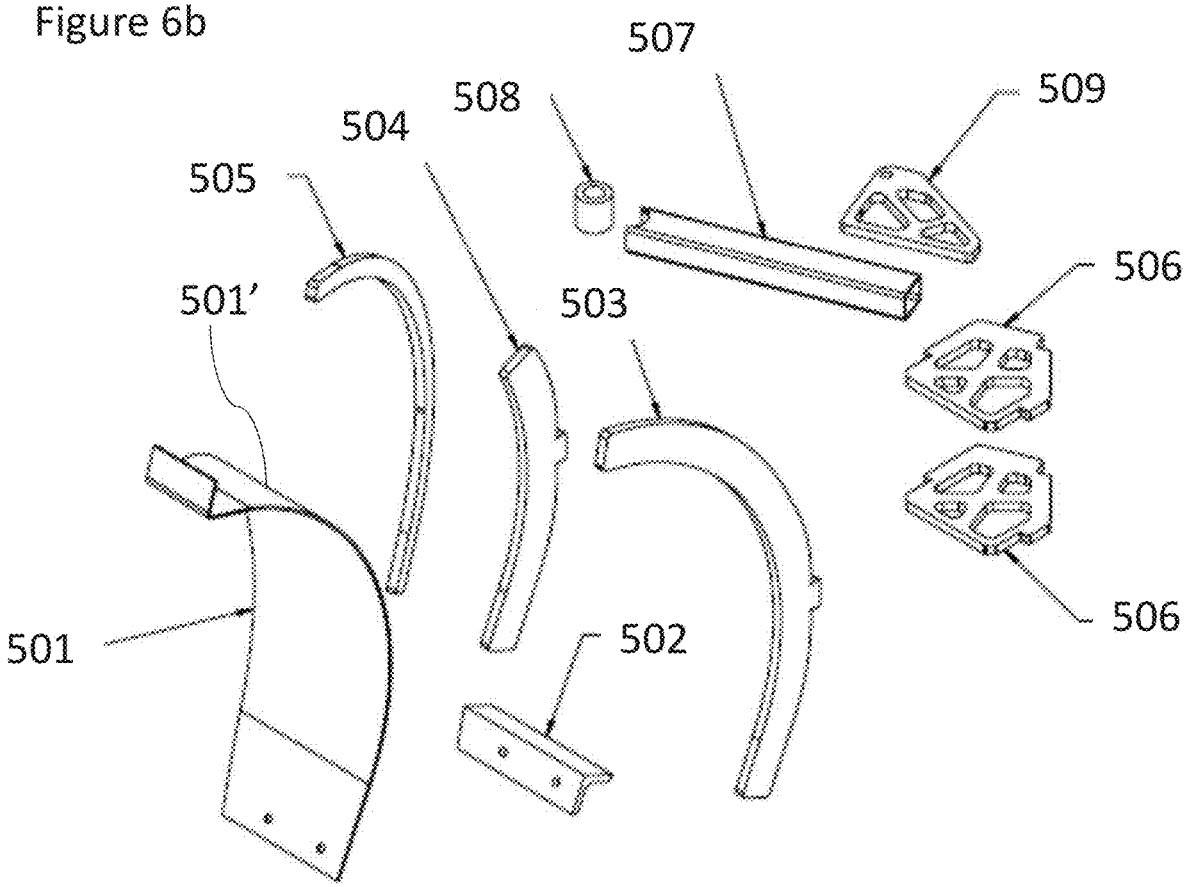
FIG. 6*b* illustrates an isometric assembly view of the wing.
Figure 6C:
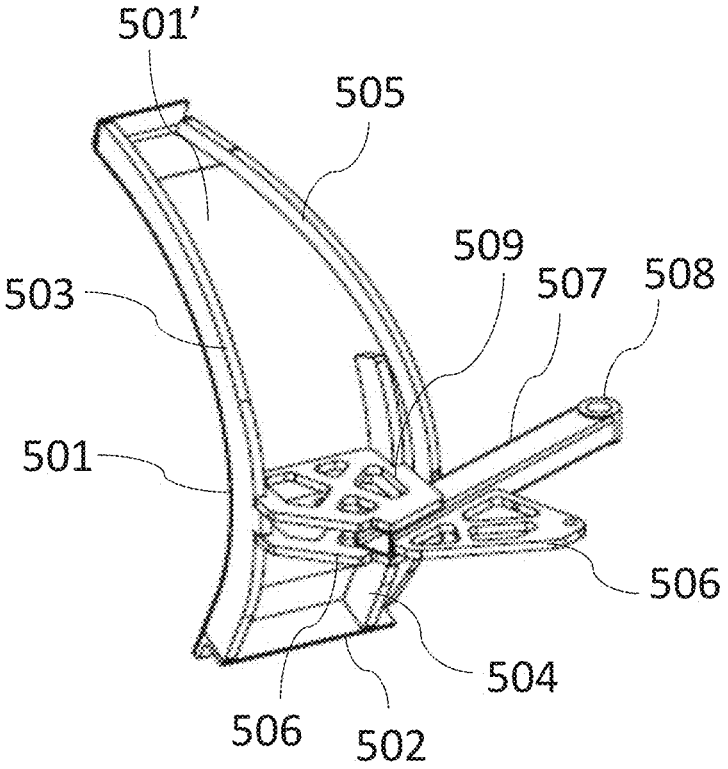
FIG. 6*c* is a rear-isometric view of the wing.
Figure 6D:
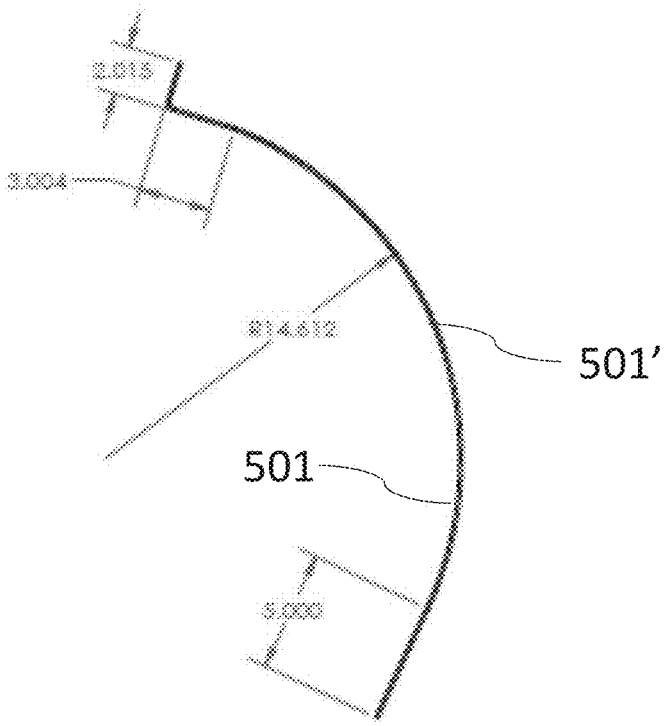
FIG. 6*d* illustrates a profile view of the wing, showing the wing radius of curvature.

FIGS. 6*a*-6*d* show views of a wing assembly (left and right). FIG. 6*a* is a front isometric exploded view of a left wing assembly, shown generally at 500. FIG. 6*b* illustrates an isometric exploded view of the wing assembly. FIG. 6*c* illustrates a rear isometric view of the wing. FIG. 6*d* illustrates a profile view of the wing, showing a bend radius of the wing. FIGS. 6*a*-6*d* show left views of a wing assembly. FIG. 6*a* illustrates a front isometric view of wing assembly, shown generally at 500. FIG. 6*b* illustrates an isometric assembly view of the left wing assembly. FIG. 6*c* illustrates a rear isometric view of the wing. FIG. 6*d* illustrates a profile view of the left side of the wing, showing a bend radius of the wing. The plow head blade (see FIG. 1*a*) includes opposing left and right wings. A preferred embodiment of the wing is shown herein at 500, representing the left wing. It is noted that the corresponding oppositely located right scoop wing is the mirror handed image of the left wing.

Wing 500 includes a scoop wing face/front 501 and back/rear 501' with a left base angle 502 mounted thereon. Back/rear 501' of scoop wing 500 has a wing outer gusset 503, wing center gusset 504 and wing inner gusset 505 mounted therein. Wing arm connector plates 506, wing arm connecting tube 507, wing arm connecting bushing 508 and wing cylinder mount plate 509 are assembled for mounting the scoop wing 500 to a plow head blade.

Figure 7A:
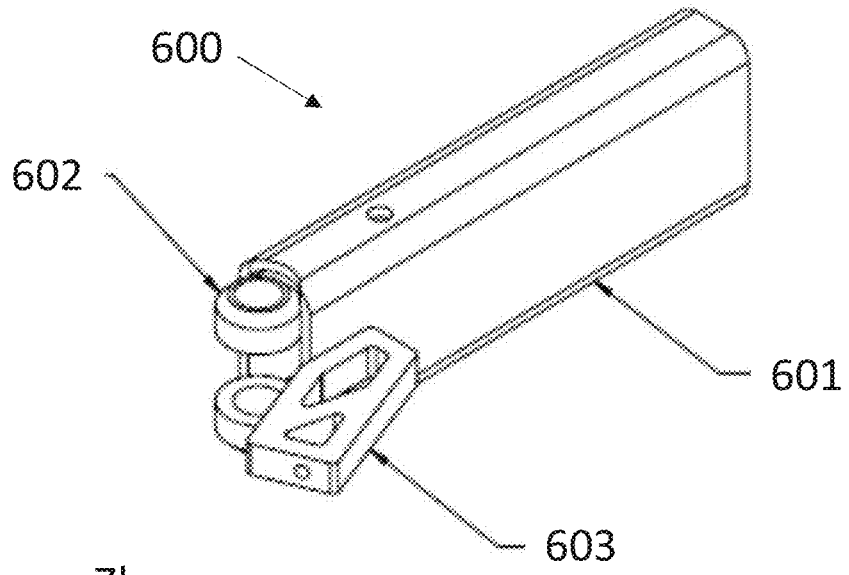
FIG. 7*a* illustrates a rear-isometric view of the left wing, slide tube, pin and stop mount assembly.
Figure 7B:
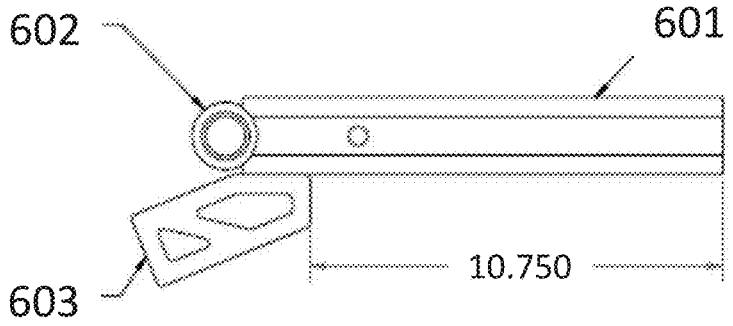
FIG. 7*b* illustrates a top view of the left wing slide tube, pin, and stop mount assembly.
Figure 7C:
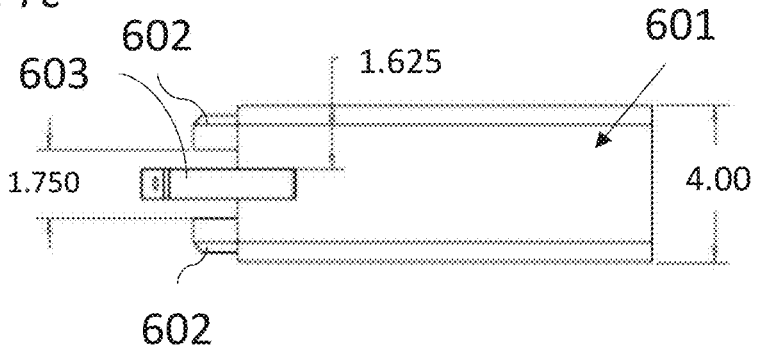
FIG. 7*c* illustrates a rear view of the wing slide tube, pin, and stop mount assembly.

FIG. 7*a* illustrates a top isometric view of the wing slide tube mount, shown generally at 600. FIG. 7*b* illustrates a top plan view of the wing slide tube mount. FIG. 7*c* illustrates a front view of the wing slide tube mount. Wing side tube mount 600 is constructed having a wing side tube 601, slide tube pin/tube 602 and slide tube wing stop 603. The wing side tube mount 600 is adapted to receive and house the wing arm connecting tube (see 507 of FIGS. 6*a*-6*d*) of a wing for securing the wing to the plow head blade.

Figure 8A:
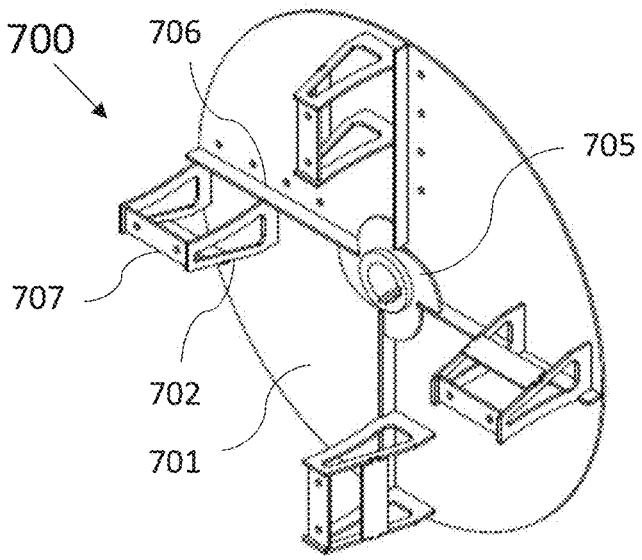
FIG. 8*a* is a top side isometric view illustrating the fan weldment.
Figure 8C:
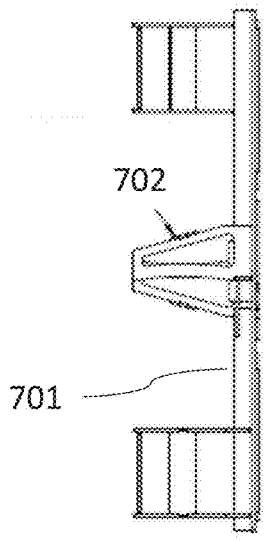
FIG. 8*c* is a side view of the fan or rotary impeller weldment.
Figure 8B:
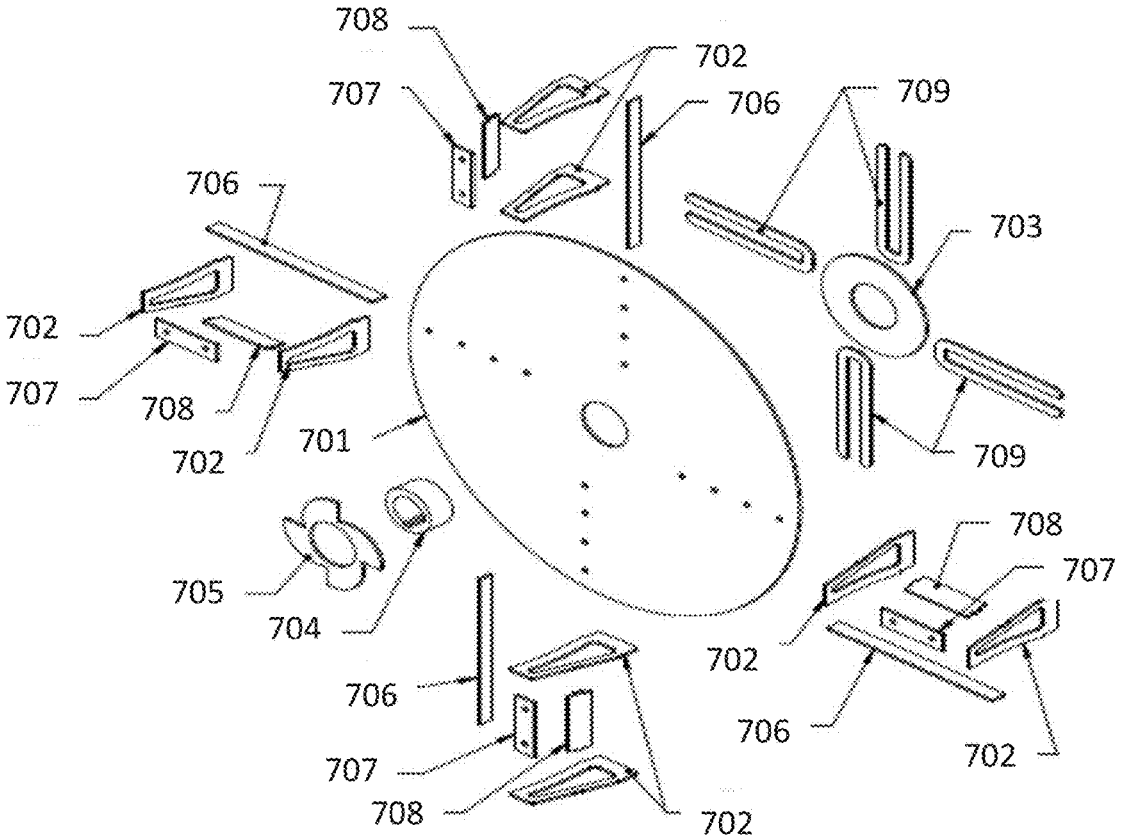
FIG. 8*b* is an exploded view illustrating the fan weldment.

FIGS. 8*a*-8*c* show views of an embodiment of a rotary fan weldment of the subject snow plow-blower. FIG. 8*a* illustrates a top isometric view of the fan weldment, shown generally at 700. FIG. 8*b* illustrates an exploded assembly view of the fan weldment. FIG. 8*c* illustrates a left side view of the fan weldment. Fan 700 is constructed generally having a fan back 701, fan blade gusset 702, ban back hub stiffener 703, fan hub 704, fan hub stiffener 705, fan back stiffener 706, blade top mount 707, blade rib stiffener 708 and fan back bolt holder 709.

Figure 9B:
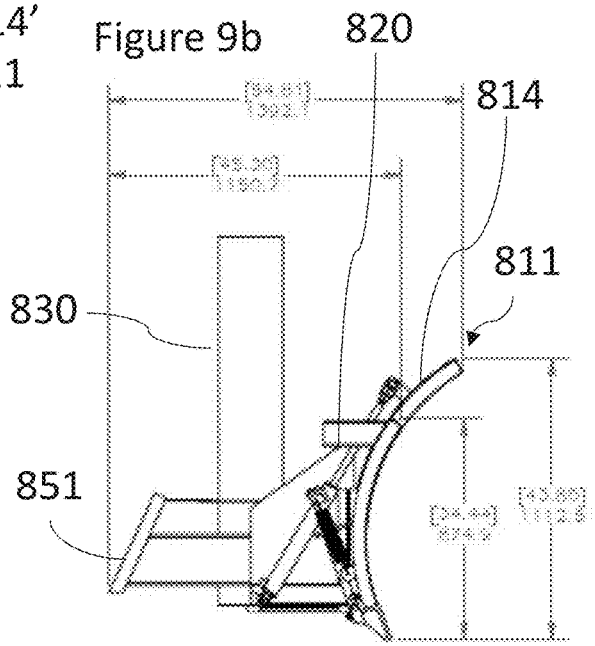
FIG. 9*b* illustrates a side view of the snow plow-blower of FIG. 9*a;*
Figure 9C:
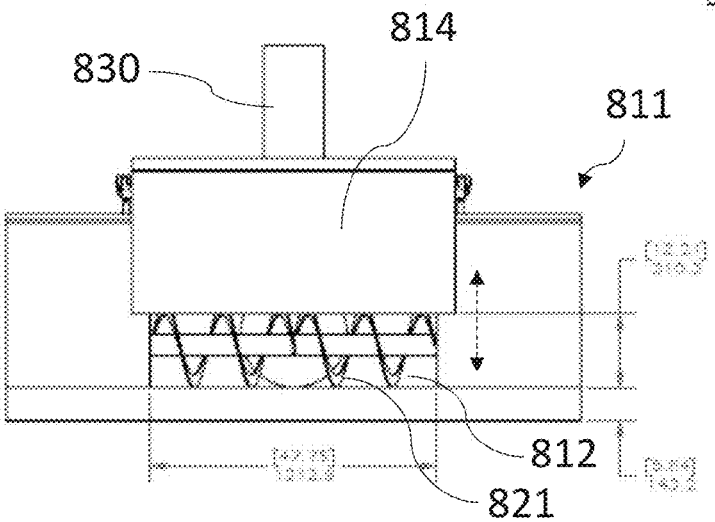
FIG. 9*c* illustrates a front view of the snow plow-blower of FIG. 9*a;*

FIGS. 9*a*-9*c* illustrate views of an embodiment of the subject snow plow-blower. FIG. 9*a* illustrates a front axonometric side view of an embodiment of the subject snow plow-blower, shown generally at 800. FIG. 9*b* illustrates a right side view of the snow plow-blower of FIG. 9*a*. FIG. 9*c* illustrates a front view of the snow plow-blower of FIG. 9*a* with the blower door partially open. The snow plow-blower 800 includes a plow head blade 811 with a cavity 812 accessible by way of an aperture 813 through blower door 814 in a partially open configuration. FIG. 9*a* shows the blower door 814 in an open configuration, exposing/opening aperture 813 and cavity 812. Cavity 812 includes a snow blower unit 820 integrated and housed therein. Snow blower unit 820 is in communication with a power source and is adapted to move snow, ice and/water, and/or other materials through the snow plow-blower 800 and force it out of at least one discharge chute 830 and/or at least one opening. Snow blower unit 820 includes an impeller (shown in FIG. 8*a*)/auger 821. The subject snow blower unit 820 may be a single stage snow blower (or snow thrower) or a dual stage snow blower. Where the snow blower is a single stage blower unit the blower includes an impeller/fan blower. Where the snow blower is a dual stage blower, the unit includes an impeller/fan and auger or alternatively one impeller/fan or an impeller/ribbon cutter or an impeller/fan and other engineered device to proficiently process and manage the removal of snow, ice and other materials.

The blower door 814 is adapted to move into open and closed positions/configurations. In one embodiment, blower door 814 is adapted to move upward and downward on the vertical plane via tongue and grooves/tracks, with corresponding mating tongue and groove/tracks of the plow head blade 811 so that the blower door 814 can move along the parabolic vertical plane as indicated at arrow 814'. As such, the blower door 814, shown as a single longitudinal door, moves upward (opening and exposing cavity 812) and/downward (closing cavity 812, causing it to become unexposed) along the parabolic vertical plane.

Plow head blade 811 is preferably attached to a pivot hinge weldment 850 (i.e. weld unit formed by welding together an assembly of pieces), which in turn is attached to a wobble plate weldment 851 for mounting to a vehicle, such as a tractor, truck, skid steer, or to a moveable machine or other mechanical implement. Plow head blade 811 further includes at least one wing and preferably two wings (not shown attached), that are adapted to pivot forward or in reverse, varying angles from 0 degrees to 90 degrees relative to the longitudinal axis of the plow head blade 811, varying bucket-like configurations laterally along the side of the plow head blade 811 to move to a retracted or closed configuration stowed behind plow head blade 811 and/or an open configuration laterally along the side of the plow head blade 811 (see FIG. 1*a*, for example). Plow head blade 811 further includes at least one wing, preferably two wings (not shown attached), that are adapted to move in pivot forward or in reverse. The wings can have angles that vary from 0 degrees to 90 degrees relative to width measure (or longitudinal) axis of plow head blade 811. The wings are not stowed behind said plow head blade as shown in FIG. 1*a*; rather the wings have a bucket-like angular configuration laterally along the side of the plow head blade 811 as shown in FIG. 10*b*.

Figure 10A:
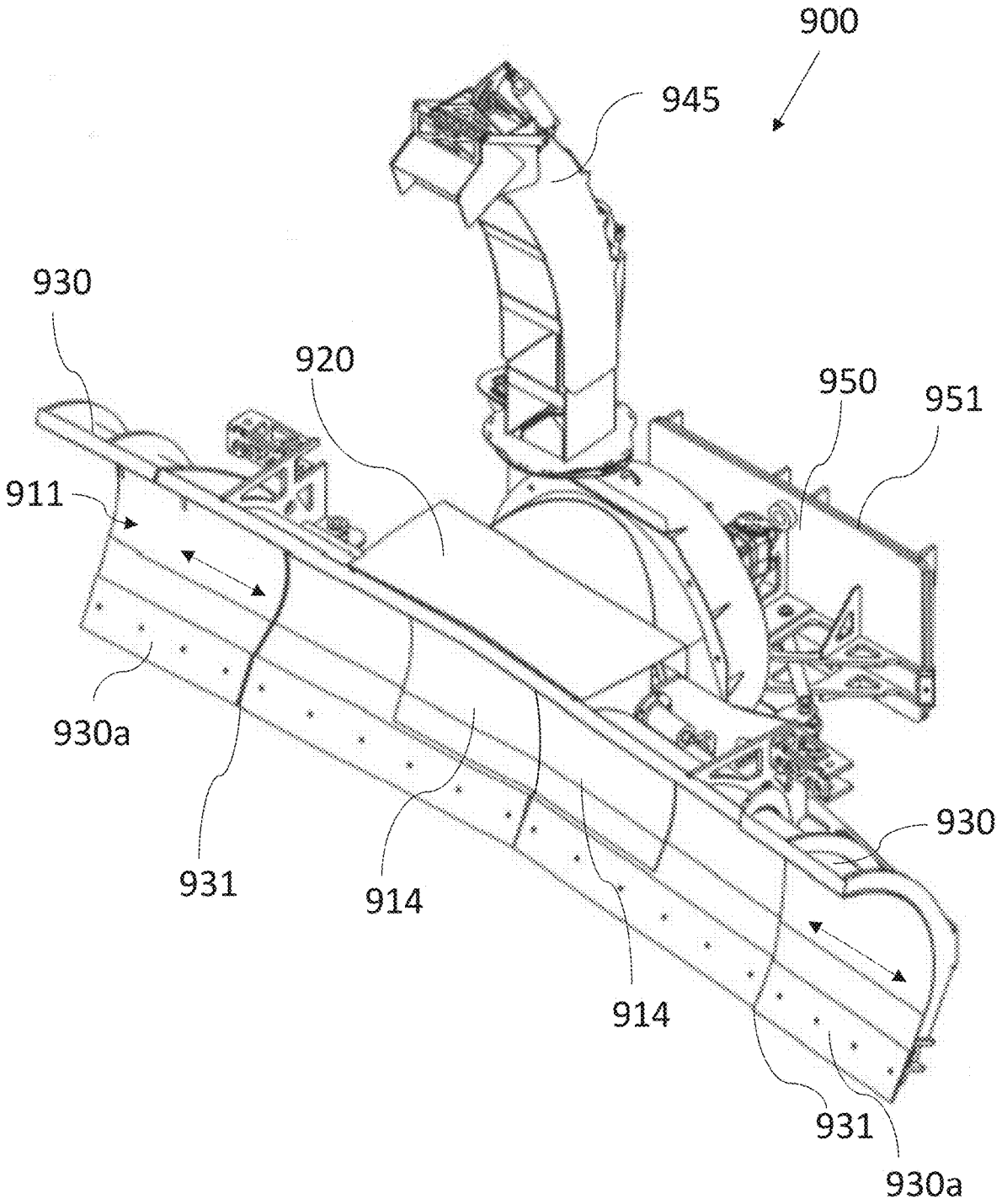
FIG. 10*a* illustrates the schematic view of another embodiment of the snow plow blower showing pivoting wings with the blower doors in a closed configuration closing the snow-blower cavity, and the wing or wings in a straight or non-pivotal position.
Figure 10B:
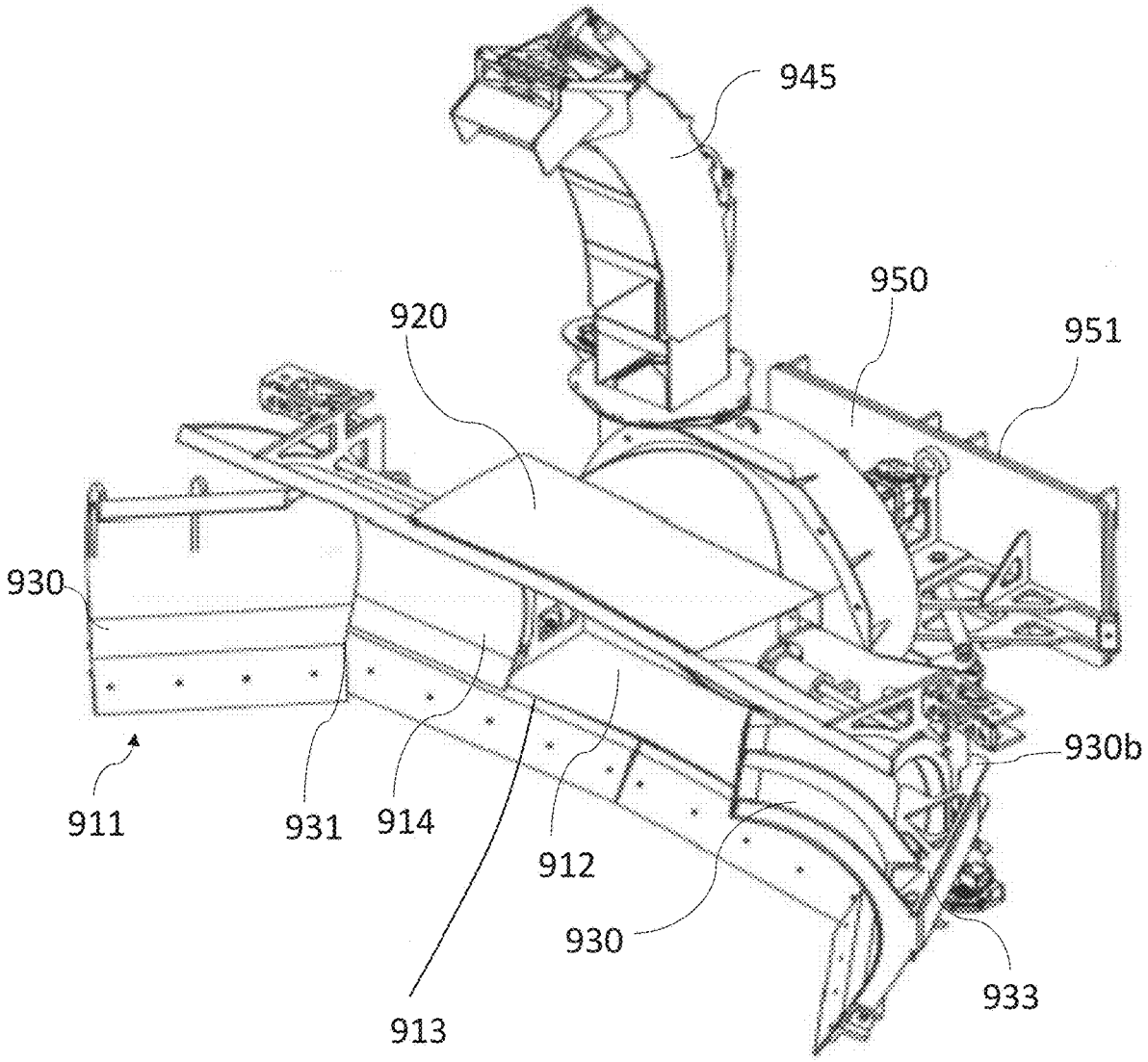
FIG. 10*b* illustrates the schematic view of the snow plow blower model with the blower doors in the open configuration exposing the snow-blower cavity, and the wing or wings in a bucket-like position.

FIG. 10*a* illustrates the schematic view of another embodiment of the snow plow blower showing a moldboard having portions thereof acting as pivoting wings with the blower doors in a closed configuration closing the snow-blower cavity, and the moldboard portions that act as wing or wings in the nonpivoted or straight plowing position, shown at 900. FIG. 10*b* illustrates the front axonometric view of the snow plow blower model with the blower doors in the open configuration exposing the snow-blower cavity, and the moldboard portions that operate as wings in a pivoted, bucket-like position. The snow plow-blower 900 generally includes a plow head blade 911 with a cavity 912 integrated therein, preferably centrally, having an aperture 913 with blower doors 914. Snow blower unit 920 is in communication with a power source and is adapted to move snow, ice and/water, and/or other materials through the snow plow-blower 900 and force it out of at least one discharge chute 930 and/or at least one opening. The blower doors 914 are adapted to move into open and closed positions/configurations. Herein two blower doors 914 are shown, however, the doors may be constructed of more than two blower doors 914 and may be formed as sliding or movable panels. Alternatively, the blower doors 914 may be formed as a single door that covers aperture 913 and cavity 912. In yet another alternative, the plow head blade does not include the integrated aperture, and acts as the blow door as it can be moved upward/downward to expose the aperture and cavity for ingress into the blower unit.

Blower doors 914 are adapted to move from the open configuration to the closed configuration, thereby completely closing and preferably sealing aperture 913 of cavity 912 and preventing all snow, ice, water or/and other material ingress into the snow blower 920 when the snow blower 920 is not being utilized. Similarly, blower doors 914 are adapted to move from a partially open to a partially closed configuration to limit the quantity of snow, ice, water and other material ingress into the snow blower 920, thereby enabling the proficient management and removal of snow, ice and other material. Plow head blade 911 is preferably attached to a pivot hinge weldment 950 (i.e. weld unit formed by welding together an assembly of pieces) so that the whole plow head blade 911 and blower unit/box and chute can be lifted or angled during plowing. In turn, weldment 950 is attached to a wobble plate weldment 951 for mounting to a tractor, truck, skid steer, or other mechanical implement.

Plow head blade 911 further includes at least one wing and preferably two wings 930, each typically located on opposing side walls 931 of the plow head blade 911. Portions of the moldboard that act as wings 930 are pivotal, retractable or movable in relation to the plow head blade 911. Moving portions of the moldboard to a pivoted, bucket-like position decreases the lateral length of the moldboard, making the plow head blade shorter in width.

Wings 930, shown at the straight plowing position 930*a*, can be pivoted along a horizontal axis 933 via hinge 930*b* so that the wings 930 move to a pivoted or angled scoop position. In the angled scoop position (i.e. position 930*b* of FIG. 10*b*) the wings 930 can channel, angle or otherwise direct the snow, ice and/or debris toward the center of the plow head blade 911 and into cavity 912 when the blower doors 914 are open. It is noted that the wings 930 are preferably arched or curved and located on opposite sides of the plow head blade 911 may be in different positions and/or geometrically different shaped embodiments. For example, one wing blade may be in the pivoted position shown at 930*b*; while the other wing blade may be in the lateral position shown at 930*a*. Further, one wing may be arched or curved and the other wing may be straight.

FIG. 11 illustrates a schematic view of another embodiment of the snow plow blower apparatus 1000 showing the blower doors open and pivoted to channel snow into the aperture and cavity with blower unit housed therein, shown generally at 1000. The snow plow-blower apparatus 1000 generally includes a plow head blade 1011 with a cavity 1012 integrated therein, preferably centrally, having an aperture 1013 with blower doors 1014. Snow blower unit 1020 is in communication with a power source and is adapted to move snow, ice and/water, and/or other materials through the snow plow-blower 1000 and force it out of at least one discharge chute 1030 and/or at least one opening. The chute may rotatable within a range from 1 to 360 degrees, said chute being a standard chute, a telescoping chute, or a folding chute or combinations thereof where the device may blow/throw snow ice and other materials in any direction required. Preferably, snow plow-blower includes at least one of hydraulic, electrically or pneumatically powered telescoping and/or folding chute, electronically controlled using a wired or wireless controller.

The blower doors 1014 are adapted to move into open and closed positions/configurations. Herein two blower doors 1014 are shown. The blower doors 1014 are moveable along a hinge track or tongue and groove-like channel to move into a pivoted position shown at 1014*b* and pivoted back against the plow head blade 1011 for a closed position. It is noted that varying degrees of pivot are contemplated to address the angle of blower doors 1014 for channeling or directing snow through aperture 1013 and into cavity 1012, thereby enabling the operation to proficiently manage the time required for removal of snow, ice and other materials. Plow head blade 1011 is preferably attached to a pivot hinge weldment 1050 attached to a wobble plate weldment 1051 for mounting to a tractor, truck, skid steer, vehicle, movable machine or other mechanical implement. Plow head blade 1011 may further include one or more wings.

Figure 12:
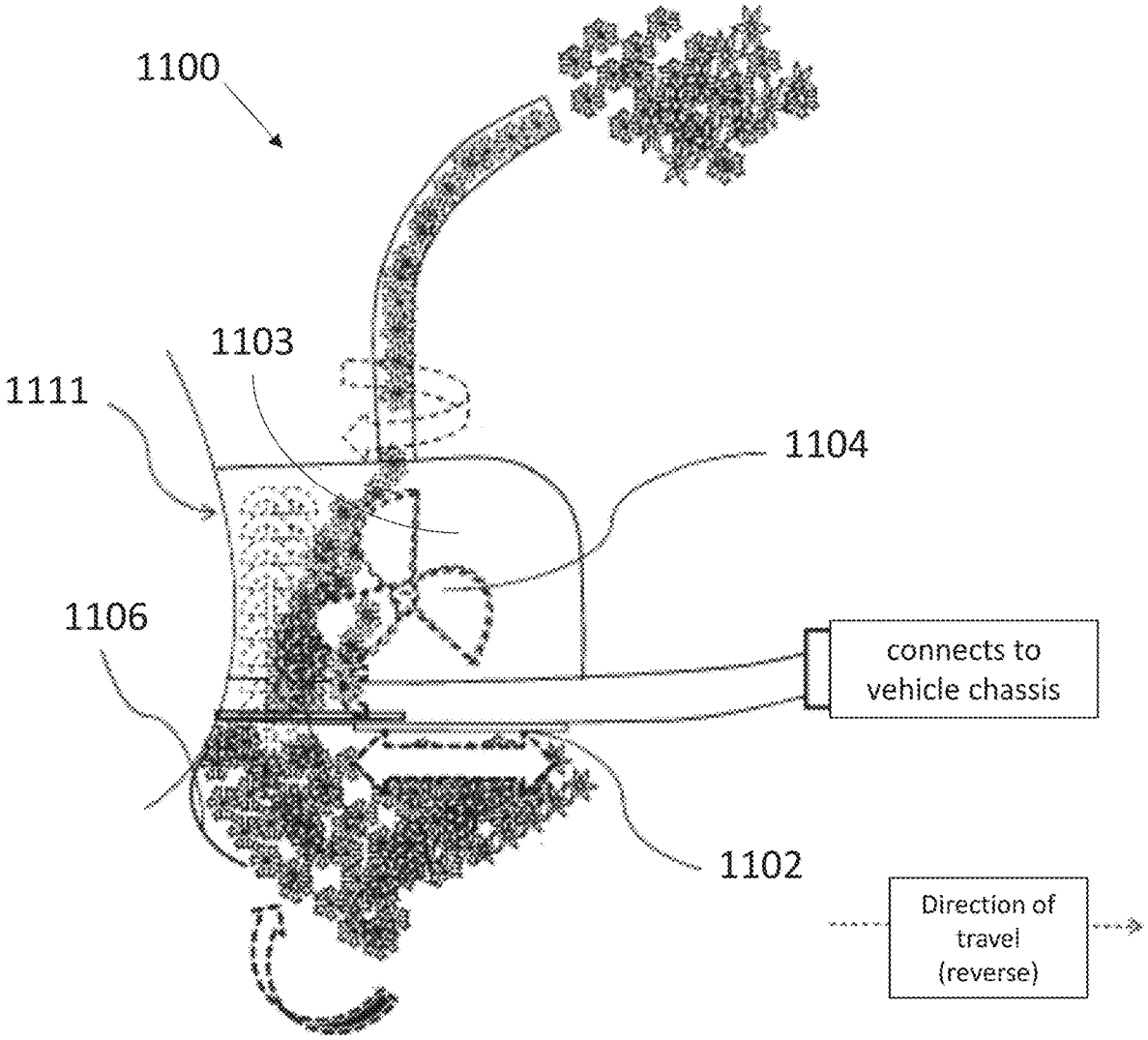
FIG. 12 illustrates an embodiment of the subject invention having a horizontally mounted door that slides open to expose the blower unit/box chamber above the back blade while the back blade directs snow simultaneously while the operating the blower and plowing in the opposite of travel (i.e., reverse).

FIG. 12 illustrates an embodiment of the subject invention having a horizontally mounted door that slides open to expose the blower unit/box chamber above the back blade while the back blade directs snow simultaneously while the operating the blower and plowing in the opposite direction of travel (i.e., in reverse), shown generally at 1100. In this embodiment a back blade 1106 is located behind plow head blade 1111. A horizontally mounted door 1102 is provided that slides open to expose a blower box chamber/cavity 1103 having a snow blower unit 1104 housed therein. The structure of the plow head blade 1111 and cavity 1103 are described herein above. The back blade 1106 is adapted to direct at least a vehicle length or moveable machine length worth of snow, ice or other material simultaneously while operating the blower and plowing in the opposite direction of travel (i.e., reverse), contemplated for use in situations, such as against a garage door or any other situation wherein a user may need to back blade snow, ice/other material; thereby enabling the user to proficiently manage the time required for removal of snow, ice/other material.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A snow plow-blower, comprising:

a. a plow having a plow head blade, a hinge, and a moldboard, said plow being hingedly moveable to a plurality of configurations, including a V-shaped configuration;

b. at least one blower door having open and closed configurations;

c. a snow blower unit for assisting said plow with movement of snow, said snow blowing unit having a cavity containing single stage snow moving means for moving snow, ice and other materials out through at least one discharge chute and/or at least one opening;

d. said at least one blower door being configured to move to a plurality of partially open positions at varying degrees that variably increase exposure of said cavity, and to a plurality of partially closed positions that variably decrease snow, ice and other material ingress into said snow blower unit, said blower door movement incrementally and intermittently positioning said door between a fully open position and a fully closed position; and e. an attachment for removeably mounting said snow plow-blower to a land vehicle.

2. The snow plow-blower as recited by claim 1, wherein said plow head blade forms said at least one blower door and said vehicle is a truck, bulldozer, loader or tractor.

3. The snow plow-blower as recited by claim 1, wherein said blower door is integrated within said plow moves incrementally therewithin to partially open and close an aperture in communication with said cavity and said vehicle is a road vehicle, utility sidewalk traveling vehicle, winter service vehicle, skidster or backhoe-loader-tractor.

4. The snow plow-blower as recited by claim 1, wherein said snow blower unit further comprises a dual stage and/or multi stage snow blower unit comprising at least one auger and impeller in communication with a power source adapted to move snow, ice and other materials into the unit and force it out of said at least one discharge chute or at least one opening.

5. The snow plow-blower as recited by claim 1, wherein said single stage snow blower unit has one (1) device selected from the group consisting of impeller, ribbon-cutter, auger, snow beater, rotary fan thrower/blower, sweeper, broom, or paddle in communication with a power source adapted to move snow, ice and other materials through said at least one discharge chute or at least one opening.

6. The snow plow-blower as recited by claim 1, wherein said snow moving means comprises one impeller in communication with a power source adapted to move snow, ice and other materials through said at least one discharge chute or at least one opening.

7. The snow plow-blower as recited by claim 1, wherein said snow moving means comprises one rotary fan thrower/blower in communication with a power source adapted to move snow, ice and other materials through said at least one discharge chute or at least one opening.

8. The snow plow-blower as recited by claim 1, wherein said snow moving means comprises one device selected from the group consisting of impeller, ribbon-cutter, snow cutter, auger, sweeper, snow beater, rotary fan thrower/blower, paddle, rotating broom, a mechanical scraper guide/electromechanical scraper guide and combinations thereof to move and manage snow, ice and other materials and force them out of said at least one discharge chute or at least one opening.

9. The snow plow-blower as recited by claim 1 wherein said hinge is located near the center of said moldboard for enabling said plow to open and transform to different shaped moldboard configurations.

10. The snow plow-blower as recited by claim 9, wherein said moldboard configurations comprise one or more of a straight blade, an angled blade, a scooped blade, a windrow blade, a wedge blade, a V-shaped blade or combinations thereof.

11. The snow plow-blower as recited by claim 1, wherein said at least one blower door is configured for movement manually or by a motor upward and downward, left and right over said cavity to partially open and close said cavity.

12. The snow plow-blower as recited by claim 11, comprising at least one vertical or horizontal mechanical track/trackless path located on said blade head being perpendicular and proximate to said at least one blower door, wherein at least one blower door is configured to be moved by said motor along said vertical or horizontal mechanical track/trackless path to yield partially open and closed positions to partially open and close said aperture of said cavity.

13. The snow plow-blower as recited by claim 1, wherein said at least one blower door is adapted to incrementally move one or more of horizontally left and right or vertically over said cavity to partially open and close said cavity through an activating device with a controller.

14. The snow plow-blower as recited by claim 13 comprising at least one horizontal or vertical mechanical track/trackless path located on said blade head being perpendicular and proximate to said at least one blower door, wherein said at least one blower door is adapted to be moved incrementally by said activating device along said at least one horizontal or vertical mechanical track/trackless path to yield partially open and closed positions to partially open and close said aperture of said cavity.

15. The snow plow-blower as recited by claim 1, wherein there are at least two blower doors.

16. The snow plow-blower as recited by claim 1, wherein said at least one blower door comprises a hinged joint so that said at least one blower door is adapted to be opened by a motor to a plurality of varying open extended positions appointed to channel snow into said aperture of said cavity and said blower unit.

17. The snow plow-blower as recited by claim 16, wherein said at least one blower door is moveable on said plow head blade to a plurality of a partially closed position, or a partially open position.

18. The snow plow-blower as recited by claim 1, comprising at least one wing located on said plow head blade.

19. The snow plow-blower as recited by claim 18, wherein there are at least two wings located on opposing side walls of said plow head blade.

20. The snow plow-blower as recited by claim 18, wherein said at least one wing is moveable on said plow head blade to a plurality of partially closed positions or partially open positions.

21. The snow plow-blower as recited by claim 18, wherein said at least one wing is arched, curved or straight or conical.

22. The snow plow-blower as recited by claim 18, wherein said at least one wing is retractable behind said plow head blade to yield one or more varying closed positions.

23. The snow plow-blower as recited by claim 18, wherein said at least one wing slides on a horizontal or vertical mechanical plane to continue from said plow head blade.

24. The snow plow-blower as recited by claim 18, wherein said at least one wing includes a pivot point laterally thereon adapted to pivot said at least one wing to an open extended pivot position in front of said plow head blade forming a scoop or pusher type removal device.

25. The snow plow-blower as recited by claim 1, wherein said snow blower unit is appointed to be powered by an engine of a vehicle or moveable machine.

26. The snow plow-blower as recited by claim 1, wherein said blower unit includes a blower, thrower, sweeper, or rotary broom engine for powering said snow plow-blower.

27. The snow plow-blower as recited by claim 26, wherein said blower, thrower, sweeper, or rotary broom engine has a horsepower of at least about 1 horsepower (746 W).

28. The snow plow-blower as recited by claim 1, wherein said blower unit includes a power source selected from the group consisting of hydraulic power, pneumatic (air/fluid) power, internal combustion engine power, mechanical energy direct linkage power including a PTO, chemical energy power, electrical energy power, energy engineered from power sources and electromagnetic energy power or energy engineered from known power sources.

29. The snow plow-blower as recited by claim 1, comprising a specific or universal wired or wireless communication controller device and switching device for operating/controlling substantially all operative functions of the Snow Plow-Blower apparatus, including but not limited to, starting and stopping operation of said snow blower, so that said snow blowing or snow throwing function and said snow plowing functions can be carried out concomitantly or independently of each other wirelessly by the use of said specific/universal wired/wireless communication/controller device, and/or a smart device type application for raising or lowering the snow plow-blower apparatus or by articulating the plow head blade attack angle, varying the pitch, yaw and roll of the plow head blade, opening and closing the doors, varying the speed of the blower, controlling the heat devices, controlling a mechanical scraper guide and/or turning headlights, LED guide lights/light bar lights on and off and turning LED lights on and off.

30. The snow plow-blower apparatus as recited by claim 29, wherein said specific or universal wired or wireless communication controller device and switching device is in communication with a specifically engineered control switch box associated with the SPB apparatus attachment, whereby permitting the control of at least one (1) motor operative to move said at least one blower door articulates the plow head blade attack angle, varies the pitch, yaw and roll of the plow head blade, partially opens and closes the at least one blower door, varies the speed of the blower and turns headlights, LED guide lights and/or light bar lights on and off, and controls the heat device and the mechanical scraper guide/electromechanical scraper guides, and protracts and retracts a telescoping and/or folding chute and/or snow beater.

31. The snow plow-blower apparatus as recited by claim 29, comprising at least one wing located on said plow head blade, wherein said specific or universal wired or wireless communication controller device and switching device is in communication with a motor operative to move said at least one blower door.

32. The snow plow-blower as recited by claim 30, comprising a specifically engineered on-board wireless controller device for the snow plow-blower specific vehicle or a universal wireless communication controller for all snow-plow-blower apparatus for all vehicles and moveable machines using known electrical, electronic, infra-red, radio, and/or blue tooth type technologies for controlling and operating said snow plow-blower apparatus and all of its moving parts and embodiments individually or at the same time, and said wireless communications controller may be engineered by the use of a smart device's downloadable applications, or separate installations.

33. The snow plow-blower as recited by claim 1, comprising a chute rotatable within a range from 1 to 360 degrees, said chute being a standard chute, a telescoping chute, or a folding chute or combinations thereof where the device may blow/throw snow ice and other materials in any direction required.

34. The snow plow-blower as recited by claim 1, comprising at least one wheel or shoe fixedly or removably mounted on ski-like skids and/or the snow plow-blower apparatus, said wheel or shoe optionally being powered to vertically displace said snow plow-blower.

35. The snow plow-blower as recited by claim 1 comprising at least one of hydraulic, electrically or pneumatically powered telescoping and/or folding chute and/or snow beater, electronically controlled using a wired or wireless controller.

36. The snow plow-blower as recited by claim 1 comprising a light tower with one or more head lights and, optionally, one or more snow guides/LED snow guides, one or more mechanical scraper guides or electromechanical scraper guides and/or a light bar and at least one heat device.

37. The snow plow-blower as recited by claim 1, comprising a back blade located behind a portion of said plow head blade, and a horizontally mounted door located behind and below said blower and adapted to slide open to expose said cavity of said snow blower unit and direct snow into said cavity when said snow plow-blower is operating in an opposite direction of travel (i.e., reverse).

38. A snow plow-blower, comprising:

a. a plow having a plow head blade, a hinge, and a moldboard, said plow being hingedly moveable to a V-shaped configuration;

b. an aperture and a cavity associated with at least one blower door having open and closed configurations;

c. a blower unit for assisting said plow with movement of snow, said snow blowing unit comprising a single stage, dual stage or multi stage blower; and said blower door being associated with a motor and configured to be moved by said motor into a plurality of partially closed and open positions at varying degrees in one or more directions including vertically upward, lift and pivot away, and rotate, that vary exposure of said blower unit and partially vary transformation of said snow plow-blower from a snow plow, said motor driving said blower door movement incrementally and intermittently positioning said door between a fully open position and a fully closed position.

39. The snow plow-blower as recited by claim 38, wherein said plow configuration comprise one or more of a straight blade, an angled blade, a scooped blade, a windrow blade, a wedge blade, a V-shaped blade or combinations thereof, and said snow blowing unit is a single stage design selected from the group consisting of snow cutter, sweeper, beater, paddle, rotating broom and combinations thereof to move snow, ice and other materials and force it out of at least one discharge chute or at least one opening.

40. The snow plow-blower as recited by claim 39, wherein said plow forms said at least one blower door and comprises an attachment for removably mounting said snow plow-blower to a truck, bulldozer, tractor or other land vehicle.

41. The snow plow-blower as recited by claim 38, wherein said aperture and said cavity is integrated within said plow and a hinge located near the center of said moldboard enable said plow to open and transform to different shaped moldboard configurations, including a V-shaped configuration, to control ingress of snow, ice and other materials into said cavity.

42. A snow plow-blower, comprising:

a. a plow having a plow head blade, a hinge, and a moldboard, said plow being hingedly moveable to a plurality of configurations, including a straight blade, an angled blade, scooped blade, windrow blade, wedge blade, V-shaped blade or combinations thereof;

b. at least one blower door having open and closed configurations;

c. a snow blower unit for assisting said plow with movement of snow, said snow blowing unit having a single stage design having snow moving means for moving snow, ice and other materials out through at least one discharge chute and/or at least one opening;

d. said at least one blower door being associated with a motor and configured to move to a first plurality of positions that variably increase exposure of said snow moving means, and to a second plurality of positions that variably decrease exposure of said snow moving means to said snow, ice and other materials, said motor driving said blower door movement to incrementally and intermittently position said door at a plurality of locations between a fully open position and a fully closed position.

43. A snow plow-blower as recited by claim 42, further comprising an attachment configured to be mounted on a land vehicle, and a heating device including a heat coil/element placed strategically on, within or about the snow moving means to prevent packing and freezing of snow/ice and other materials build up.

* * * * *